US007353168B2

(12) United States Patent
Thyssen et al.

(10) Patent No.: US 7,353,168 B2
(45) Date of Patent: Apr. 1, 2008

(54) METHOD AND APPARATUS TO ELIMINATE DISCONTINUITIES IN ADAPTIVELY FILTERED SIGNALS

(75) Inventors: Jes Thyssen, Laguna Niguel, CA (US); Chris C Lee, Irvine, CA (US); Juin-Hwey Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 911 days.

(21) Appl. No.: 10/183,418

(22) Filed: Jun. 28, 2002

(65) Prior Publication Data

US 2003/0088408 A1 May 8, 2003

Related U.S. Application Data

(60) Provisional application No. 60/326,449, filed on Oct. 3, 2001.

(51) Int. Cl.
*G10L 19/10* (2006.01)

(52) U.S. Cl. ..... 704/220; 704/207; 704/223; 704/230

(58) Field of Classification Search ..... 704/219, 704/220, 230, 207, 223, 262, 229
See application file for complete search history.

(56) References Cited

U.S. PATENT DOCUMENTS 4,617,676 A 10/1986 Jayant et al. ..... 375/27
4,752,956 A 6/1988 Sluijter
4,969,192 A 11/1990 Chen et al. ..... 381/31
5,233,660 A * 8/1993 Chen ..... 704/208
5,241,650 A 8/1993 Gerson et al.
5,651,091 A * 7/1997 Chen ..... 704/223
5,664,055 A 9/1997 Kroon
5,680,507 A * 10/1997 Chen ..... 704/223
5,699,485 A * 12/1997 Shoham ..... 704/223
5,745,871 A * 4/1998 Chen ..... 704/207
5,819,212 A * 10/1998 Matsumoto et al. ..... 704/219
5,828,996 A * 10/1998 Iijima et al. ..... 704/220

(Continued)

FOREIGN PATENT DOCUMENTS

EP 0 732 687 9/1996

OTHER PUBLICATIONS

Mustapha, A. and Yeldener, S., "An Adaptive Post-Filtering Technique Based on the Modified Yule-Walker Filter, " *Proceedings of the IEEE International Conference on Acoustics, Speech, and Signal Processing*, IEEE, vol. 1, Mar. 1999, pp. 197-200.

(Continued)

*Primary Examiner*—Vijay Chawan
(74) *Attorney, Agent, or Firm*—Sterne, Kessler, Goldstein & Fox PLLC

(57) ABSTRACT

A method to eliminate discontinuities in an adaptively filtered signal includes filtering a beginning portion of a current signal frame using a past set of filter coefficients, thereby producing a first filtered frame portion. The method also includes filtering the beginning portion of the current signal frame using a current set of filter coefficients, thereby producing a second filtered frame portion. The method also includes modifying the second filtered frame portion with the first filtered frame portion so as to smooth a possible filtered signal discontinuity between the second filtered frame portion and a past filtered frame produced using the past filter coefficients.

25 Claims, 13 Drawing Sheets

U.S. PATENT DOCUMENTS

| | | | | |
|---|---|---|---|---|
| 5,864,798 | A | 1/1999 | Miscki et al. | |
| 5,867,814 | A | 2/1999 | Yong | |
| 5,884,010 | A | 3/1999 | Chen et al. | |
| 5,890,108 | A | 3/1999 | Yeldener | |
| 5,999,899 | A | 12/1999 | Robinson | |
| 6,014,621 | A | 1/2000 | Chen | |
| 6,073,092 | A | 6/2000 | Kwon | |
| 6,078,880 | A * | 6/2000 | Zinser et al. | 704/208 |
| 6,094,629 | A * | 7/2000 | Grabb et al. | 704/219 |
| 6,104,992 | A | 8/2000 | Gao et al. | |
| 6,173,255 | B1 | 1/2001 | Wilson et al. | |
| 6,219,637 | B1 | 4/2001 | Choi et al. | |
| 6,330,533 | B2 * | 12/2001 | Su et al. | 704/220 |
| 6,385,573 | B1 | 5/2002 | Gao et al. | |
| 6,449,590 | B1 * | 9/2002 | Gao | 704/219 |
| 6,507,814 | B1 * | 1/2003 | Gao | 704/220 |
| 6,584,438 | B1 * | 6/2003 | Manjunath et al. | 704/228 |
| 6,584,441 | B1 | 6/2003 | Ojala et al. | |
| 6,629,068 | B1 | 9/2003 | Horos et al. | |
| 6,665,638 | B1 | 12/2003 | Kang et al. | |
| 6,691,092 | B1 | 2/2004 | Udaya Bhaskar et al. | |
| 6,816,832 | B2 | 11/2004 | Alanara et al. | |
| 6,826,527 | B1 | 11/2004 | Unno | |
| 6,842,733 | B1 | 1/2005 | Gao et al. | |
| 2002/0123887 | A1 * | 9/2002 | Unno | 704/220 |
| 2003/0088405 | A1 | 5/2003 | Chen | |
| 2003/0088408 | A1 | 5/2003 | Thyssen et al. | |
| 2003/0097258 | A1 | 5/2003 | Thyssen | |

OTHER PUBLICATIONS

Salami, R. et al., "Design and Description of CS-ACELP : A Toll Quality 8 kb/s Speech Coder," *IEEE Transactions on Speech and Audio Processing*, IEEE, vol. 6, No. 2, Mar. 1998, pp. 116-130.

Yatsuzuka, Y. et al., "A Variable Rate Coding by AFC with Maximum Likelihood Quantization from 4.8 KBIT/S to 16 KBIT/S," *Proceedings of the IEEE Acoustics, Speech, and Signal Processing Society*, IEEE, vol. 4, Apr. 1986, pp. 3071-3074.

U.S. Appl. No. 10/183,554, filed Jun. 28, 2002, Juin-Hwey Chen et al.

U.S. Appl. No. 10/215,048, filed Aug. 09, 2002, Juin-Hwey Chen et al.

Chen, J-H and Gersho, A., "Real-Time Vector APC Speech Coding at 4800 BPS with Adaptive Postfiltering," *Proceedings of the IEEE International Conference on Acoustics, Speech, and Signal Processing*, IEEE, Apr. 1987, vol. 4, pp. 2185-2188.

Chen, J-H. And Gersho, A., "Adaptive Postfiltering for Quality Enhancement of Coded Speech," *IEEE Transactions on Speech and Audio Processing*, IEEE, vol. 3, No. 1, Jan. 1995, pp. 59-71.

Gerson, I. and Jasiuk, M., "Vector Sum Excited Linear Prediction (VSELP) Speech Coding at 8 KBPS," *Proceedings of IEEE International Conference on Acoustics, Speech, and Signal Processing*, IEEE, Apr. 1990, pp. 461-464.

European Search Report issued Jun. 3, 2004 in EP Appl. No. 02256894.3, (3 pages).

European Search Report issued Jun. 7, 2004 in EP Appl. No. 02256895.0, (2 pages).

European Search Report issued Jun. 8, 2004 in EP Appl. No. 02256896.8, (3 pages).

Un, Chong Kwan, Magill, D. Thomas, "The Residual-Excited Linear Prediction Vocoder with Transmission Rate Below 9.6 kbits/s," IEEE Transactions on Communications, vol. 23, No. 12, Dec. 1975.

* cited by examiner

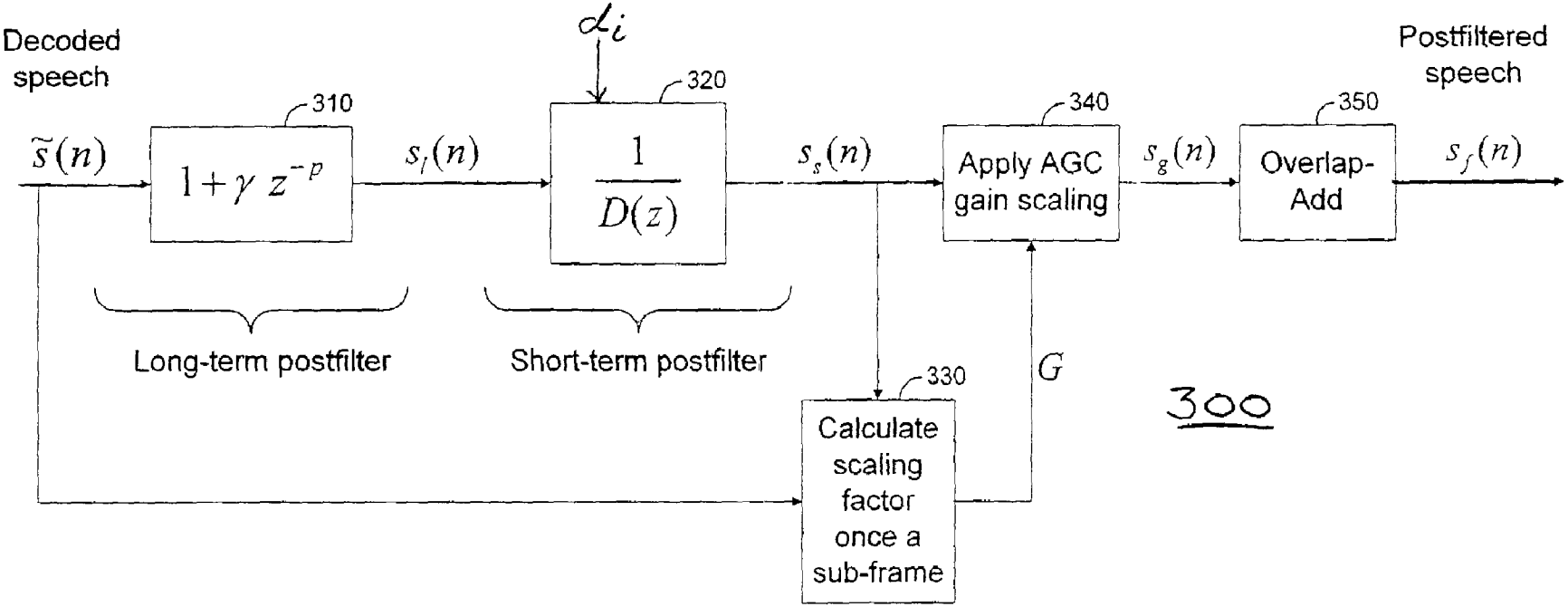
Figure 3 Basic structure of an adaptive postfilter in the present invention

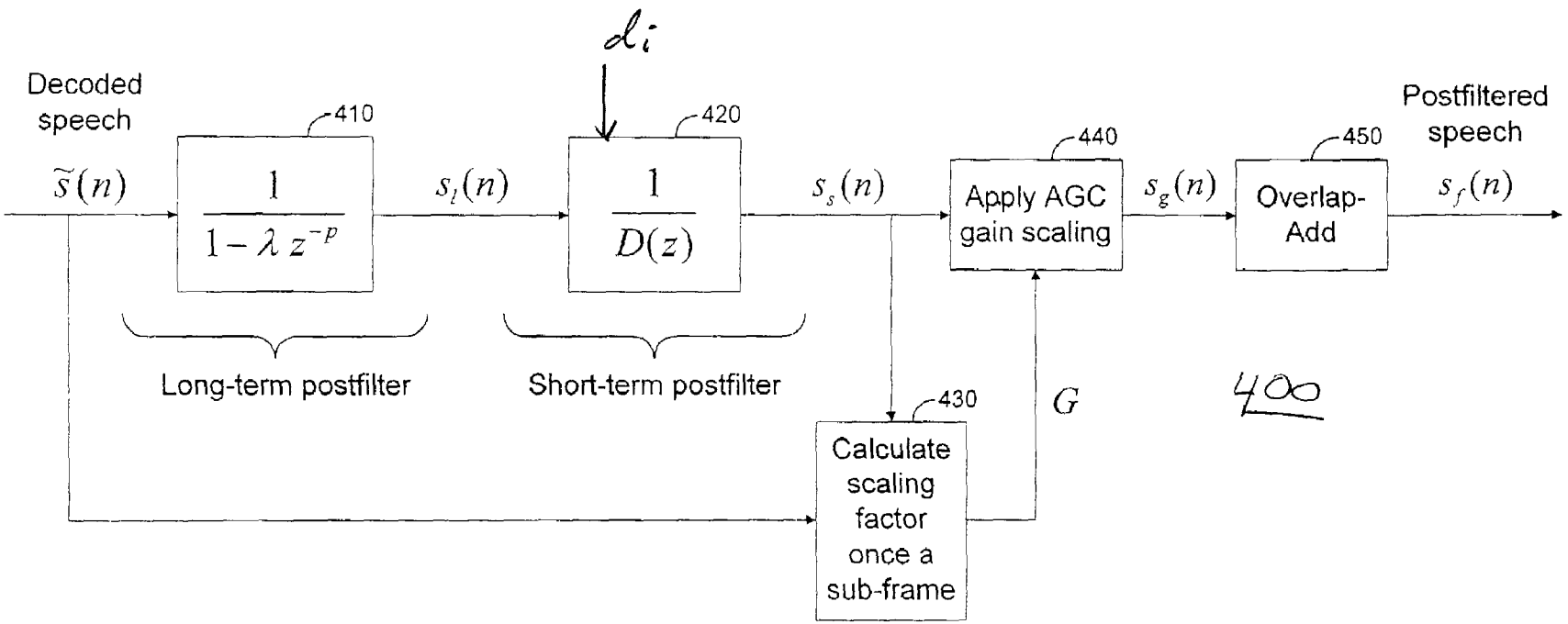
Figure 4 An alternative adaptive postfilter with an all-pole long-term postfilter

METHOD AND APPARATUS TO ELIMINATE DISCONTINUITIES IN ADAPTIVELY FILTERED SIGNALS

CROSS-REFERENCE TO RELATED APPLICATIONS

This application claims priority to U.S. Provisional Application No. 60/326,449, filed Oct. 3, 2001, entitled "Adaptive Postfiltering Methods and Systems for Decoded Speech," incorporated herein by reference in its entirety.

BACKGROUND OF THE INVENTION

1. Field of the Invention

The present invention relates generally to techniques for filtering signals, and more particularly, to techniques to eliminate discontinuities in adaptively filtered signals.

2. Related Art

In digital speech communication involving encoding and decoding operations, it is known that a properly designed adaptive filter applied at the output of the speech decoder is capable of reducing the perceived coding noise, thus improving the quality of the decoded speech. Such an adaptive filter is often called an adaptive postfilter, and the adaptive postfilter is said to perform adaptive postfiltering.

Adaptive postfiltering can be performed using frequency-domain approaches, that is, using a frequency-domain postfilter. Conventional frequency-domain approaches disadvantageously require relatively high computational complexity, and introduce undesirable buffering delay for overlap-add operations used to avoid waveform discontinuities at block boundaries. Therefore, there is a need for an adaptive postfilter that can improve the quality of decoded speech, while reducing computational complexity and buffering delay relative to conventional frequency-domain postfilters.

Adaptive postfiltering can also be performed using time-domain approaches, that is, using a time-domain adaptive postfilter. A known time-domain adaptive postfilter includes a long-term postfilter and a short-term postfilter. The long-term postfilter is used when the speech spectrum has a harmonic structure, for example, during voiced speech when the speech waveform is almost periodic. The long-term postfilter is typically used to perform long-term filtering to attenuate spectral valleys between harmonics in the speech spectrum. The short-term postfilter performs short-term filtering to attenuate the valleys in the spectral envelope, i.e., the valleys between formant peaks. A disadvantage of some of the older time-domain adaptive postfilters is that they tend to make the postfiltered speech sound muffled, because they tend to have a lowpass spectral tilt during voiced speech. More recently proposed conventional time-domain postfilters greatly reduce such spectral tilt, but at the expense of using much more complicated filter structures to achieve this goal. Therefore, there is a need for an adaptive postfilter that reduces such spectral tilt with a simple filter structure.

It is desirable to scale a gain of an adaptive postfilter so that the postfiltered speech has roughly the same magnitude as the unfiltered speech. In other words, it is desirable that an adaptive postfilter include adaptive gain control (AGC). However, AGC can disadvantageously increase the computational complexity of the adaptive postfilter. Therefore, there is a need for an adaptive postfilter including AGC, where the computational complexity associated with the AGC is minimized.

SUMMARY OF THE INVENTION

The present invention is a time-domain adaptive postfiltering approach. That is, the present invention uses a time-domain adaptive postfilter for improving decoded speech quality, while reducing computational complexity and buffering delay relative to conventional frequency-domain postfiltering approaches. When compared with conventional time-domain adaptive postfilters, the present invention uses a simpler filter structure.

The time-domain adaptive postfilter of the present invention includes a short-term filter and a long-term filter. The short-term filter is an all-pole filter. Advantageously, the all-pole short-term filter has minimal spectral tilt, and thus, reduces muffling in the decoded speech. On average, the simple all-pole short-term filter of the present invention achieves a lower degree of spectral tilt than other known short-term postfilters that use more complicated filter structures.

Unlike conventional time-domain postfilters, the postfilter of the present invention does not require the use of individual scaling factors for the long-term postfilter and the short-term postfilter. Advantageously, the present invention only needs to apply a single AGC scaling factor at the end of the filtering operations, without adversely affecting decoded speech quality. Furthermore, the AGC scaling factor is calculated only once a sub-frame, thereby reducing computational complexity in the present invention. Also, the present invention does not require a sample-by-sample lowpass smoothing of the AGC scaling factor, further reducing computational complexity.

The postfilter advantageously avoids waveform discontinuity at sub-frame boundaries, because it employs a novel overlap-add operation that smoothes, and thus, substantially eliminates, possible waveform discontinuity. This novel overlap-add operation does not increase the buffering delay of the filter in the present invention.

An embodiment of the present invention is a method of smoothing an adaptively filtered signal. The signal includes successive signal frames of signal samples. The signal can be any signal, such as a speech and/or audio related signal. The method comprises: (a) filtering a beginning portion of a current signal frame using a past set of filter coefficients, thereby producing a first filtered frame portion; (b) filtering the beginning portion of the current signal frame using a current set of filter coefficients, thereby producing a second filtered frame portion; and (c) modifying the second filtered frame portion with the first filtered frame portion so as to smooth, and thus, substantially eliminate, a possible filtered signal discontinuity between the second filtered frame portion and a past filtered frame produced using the past filter coefficients.

Other embodiments of the present invention described below include further methods of smoothing adaptively filtering signals, a computer program product for causing a computer to perform such a process, and an apparatus for performing such a process.

BRIEF DESCRIPTION OF THE FIGURES

The present invention is described with reference to the accompanying drawings. In the drawings, like reference numbers indicate identical or functionally similar elements. The terms "past" and "current" used herein indicate a relative timing relationship and may be interchanged with the terms "current" and "next"/"future," respectively, to indicate the same timing relationship. Also, each of the above-mentioned terms may be interchanged with terms such as "first" or "second," etc., for convenience.

FIG. 3 is a block diagram of an example adaptive postfilter of the postfilter system of FIG. 1A.

FIG. 4 is a block diagram of an alternative adaptive postfilter of the postfilter system of FIG. 1A.

DETAILED DESCRIPTION OF THE INVENTION

In speech coding, the speech signal is typically encoded and decoded frame by frame, where each frame has a fixed length somewhere between 5 ms to 40 ms. In predictive coding of speech, each frame is often further divided into equal-length sub-frames, with each sub-frame typically lasting somewhere between 1 and 10 ms. Most adaptive postfilters are adapted sub-frame by sub-frame. That is, the coefficients and parameters of the postfilter are updated only once a sub-frame, and are held constant within each sub-frame. This is true for the conventional adaptive postfilter and the present invention described below.

1. Postfilter System Overview

Figure 1A:
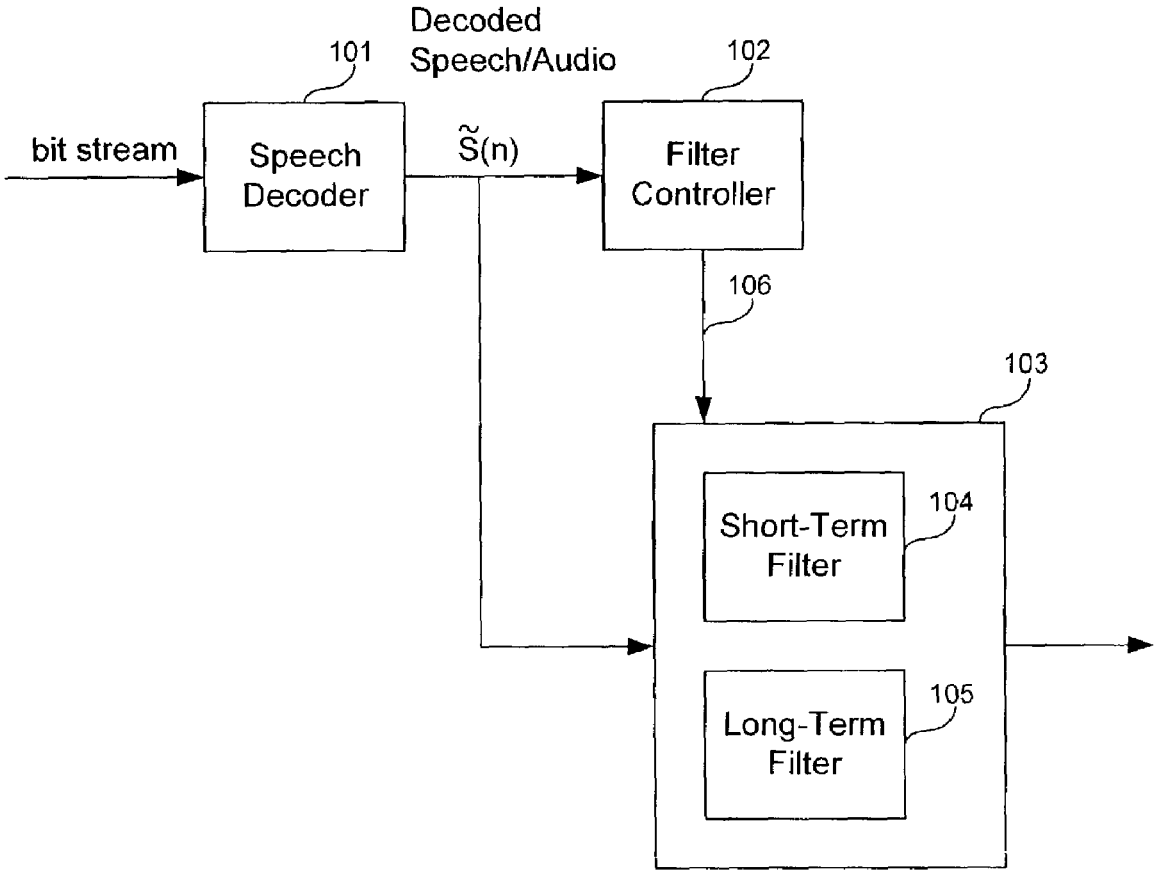
FIG. 1A is block diagram of an example postfilter system for processing speech and/or audio related signals, according to an embodiment of the present invention.

FIG. 1A is block diagram of an example postfilter system for processing speech and/or audio related signals, according to an embodiment of the present invention. The system includes a speech decoder 101 (which forms no part of the present invention), a filter controller 102, and an adaptive postfilter 103 (also referred to as a filter 103) controlled by controller 102. Filter 103 includes a short-term postfilter 104 and a long-term postfilter 105 (also referred to as filters 104 and 105, respectively).

Speech decoder 101 receives a bit stream representative of an encoded speech and/or audio signal. Decoder 101 decodes the bit stream to produce a decoded speech (DS) signal$\tilde{s}(n)$. Filter controller 102 processes DS signal $\tilde{s}(n)$ to derive/produce filter control signals 106 for controlling filter 103, and provides the control signals to the filter. Filter control signals 106 control the properties of filter 103, and include, for example, short-term filter coefficients $d_i$ for short-term filter 104, long-term filter coefficients for long-term filter 105, AGC gains, and so on. Filter controller 102 re-derives or updates filter control signals 106 on a periodic basis, for example, on a frame-by-frame, or a subframe-by-subframe, basis when DS signal $\tilde{s}(n)$ includes successive DS frames, or subframes.

Filter 103 receives periodically updated filter control signals 106, and is responsive to the filter control signals. For example, short-term filter coefficients $d_i$, included in control signals 106, control a transfer function (for example, a frequency response) of short-term filter 104. Since control signals 106 are updated periodically, filter 103 operates as an adaptive or time-varying filter in response to the control signals.

Filter 103 filters DS signal $\tilde{s}(n)$ in accordance with control signals 106. More specifically, short-term and long-term filters 104 and 105 filter DS signal $\tilde{s}(n)$ in accordance with control signals 106. This filtering process is also referred to as "postfiltering" since it occurs in the environment of a postfilter. For example, short-term filter coefficients $d_i$ cause short-term filter 104 to have the above-mentioned filter response, and the short-term filter filters DS signal $\tilde{s}(n)$ using this response. Long-term filter 105 may precede short-term filter 104, or vice-versa.

2. Short-Term Postfilter

2.1 Conventional Postfilter—Short-Term Postfilter

Figure 1B:
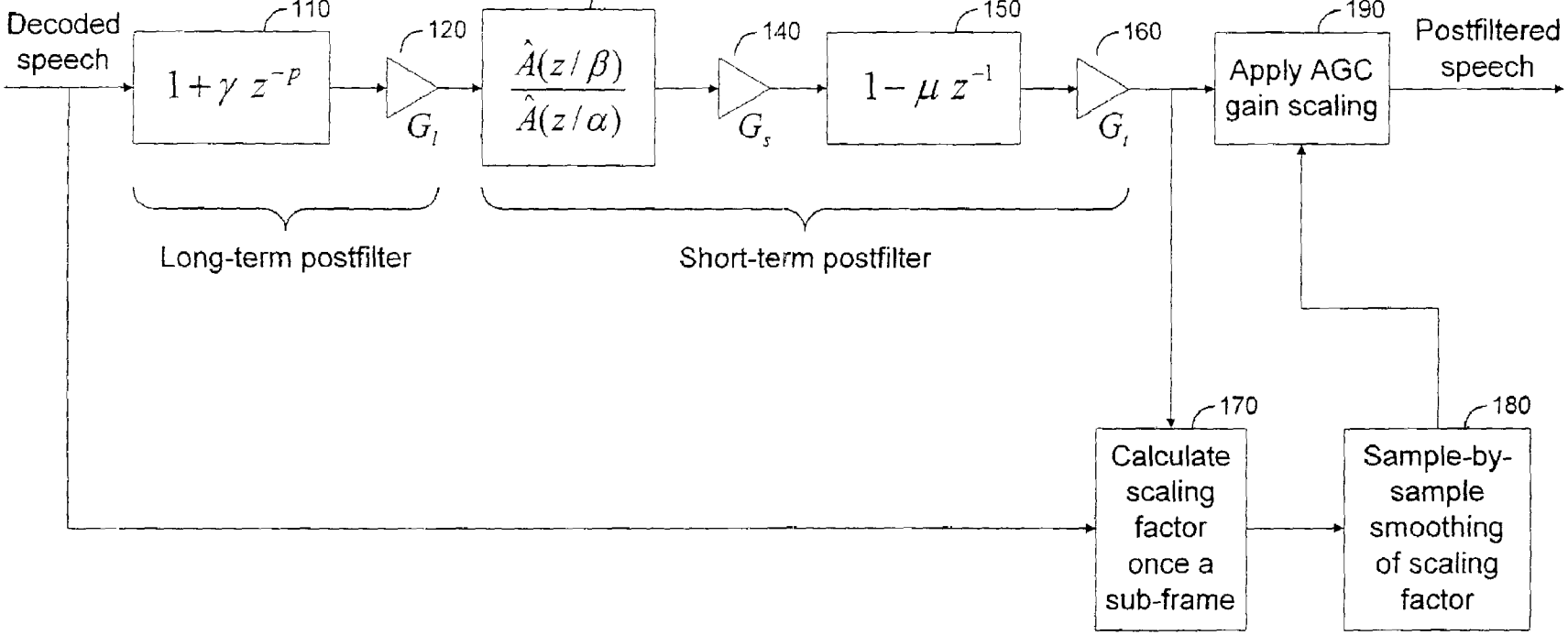
FIG. 1B is block diagram of a Prior Art adaptive postfilter in the ITU-T Recommendation G.729 speech coding standard.

A conventional adaptive postfilter, used in the ITU-T Recommendation G.729 speech coding standard, is depicted in FIG. 1B. Let $$\frac{1}{\hat{A}(z)}$$

be the transfer function of the short-term synthesis filter of the G.729 speech decoder. The short-term postfilter in FIG. 1B consists of a pole-zero filter with a transfer function of $$\frac{\hat{A}(z/\beta)}{\hat{A}(z/\alpha)},$$

where $0<\beta<\alpha<1$, followed by a first-order all-zero filter $1-\mu z^{-1}$. Basically, the all-pole portion of the pole-zero filter, or $$\frac{1}{\hat{A}(z/\alpha)},$$

gives a smoothed version of the frequency response of short-term synthesis filter $$\frac{1}{\hat{A}(z)},$$

which itself approximates the spectral envelope of the input speech. The all-zero portion of the pole-zero filter, or $\hat{A}(z/\beta)$, is used to cancel out most of the spectral tilt in $$\frac{1}{\hat{A}(z/\alpha)}.$$

However, it cannot completely cancel out the spectral tilt. The first-order filter $1-\mu z^{-1}$ attempts to cancel out the remaining spectral tilt in the frequency response of the pole-zero filter $$\frac{\hat{A}(z/\beta)}{\hat{A}(z/\alpha)}.$$

2.2 Filter Controller and Method of Deriving Short-Term Filter Coefficients

In a postfilter embodiment of the present invention, the short-term filter (for example, short-term filter 104) is a simple all-pole filter having a transfer function $$\frac{1}{D(z)}.$$

Figure 2A:
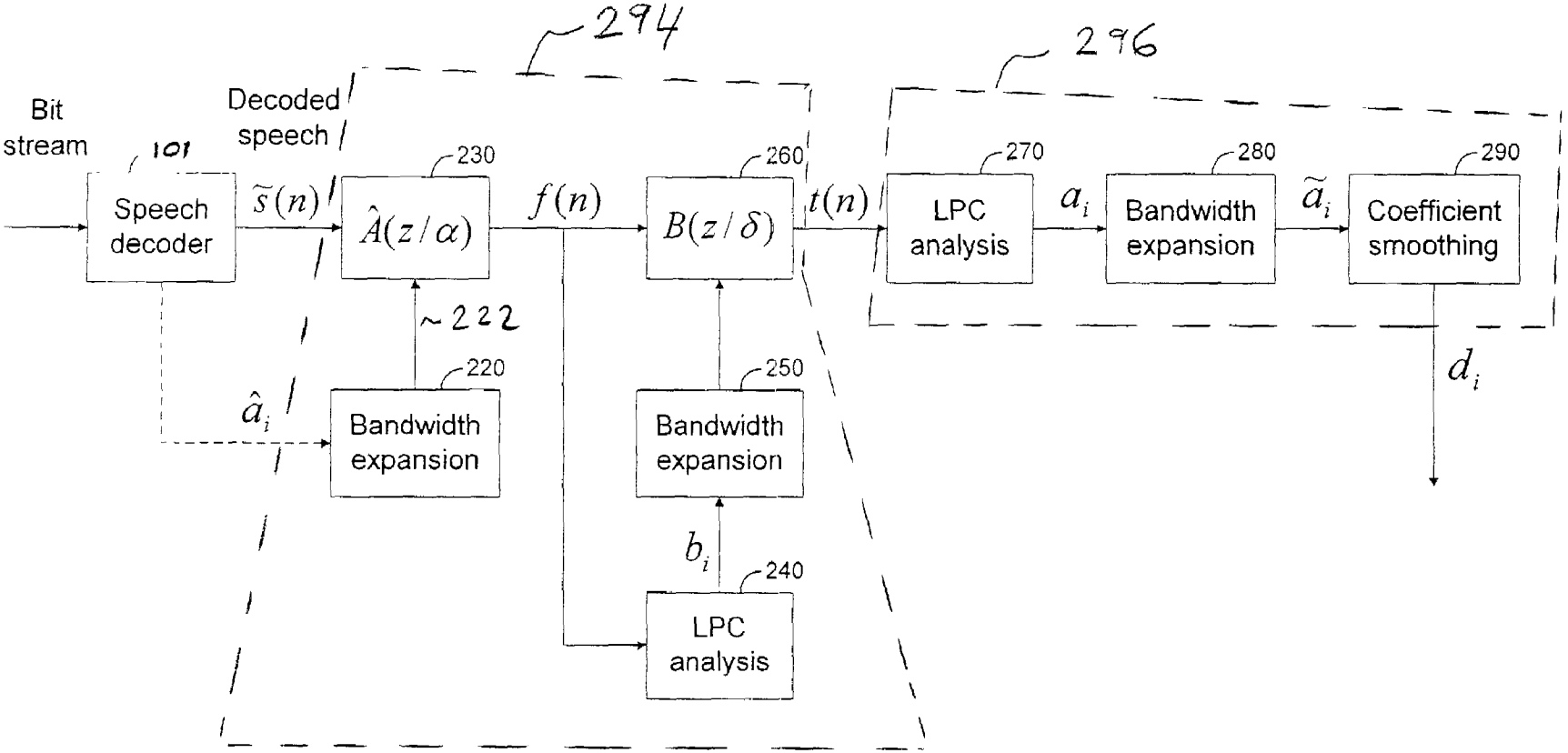
FIG. 2A is a block diagram of an example filter controller of FIG. 1A for deriving short-term filter coefficients.
Figure 2B:
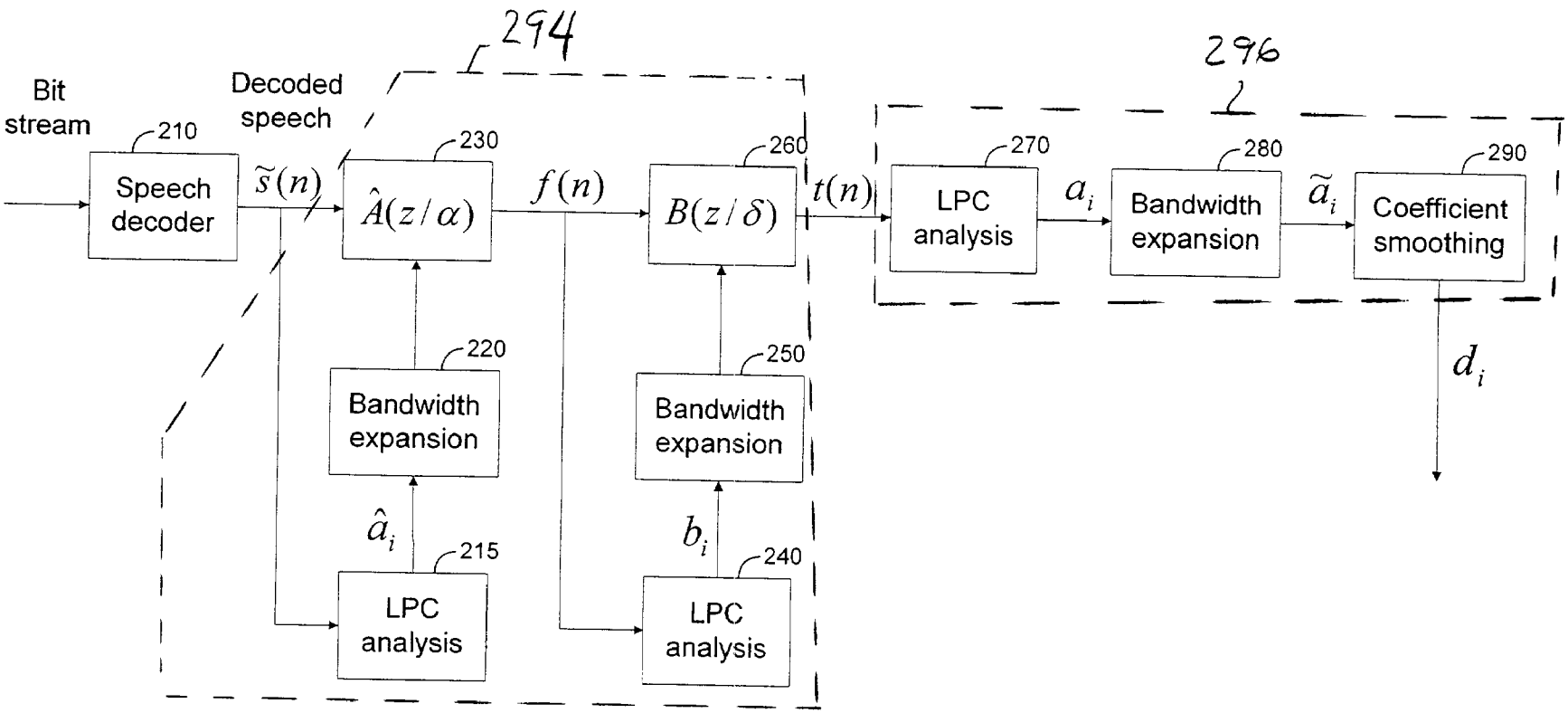
FIG. 2B is a block diagram of another example filter controller of FIG. 1A for deriving short-term filter coefficients.

FIGS. 2A and 2B are block diagrams of two different example filter controllers, corresponding to filter controller 102, for deriving the coefficients $d_i$ of the polynomial D(z), where i=1, 2, . . . , L and L is the order of the short-term postfilter. It is to be understood that FIGS. 2A and 2B also represent respective methods of deriving the coefficients of the polynomial D(z), performed by filter controller 102. For example, each of the functional blocks, or groups of functional blocks, depicted in FIGS. 2A and 2B perform one or more method steps of an overall method for processing decoded speech.

Assume that the speech codec is a predictive codec employing a conventional LPC predictor, with a short-term synthesis filter transfer function of $$H(z) = \frac{1}{\hat{A}(z)}$$

where $$\hat{A}(z) = \sum_{i=0}^{M} \hat{a}_i z^{-1},$$

and M is the LPC predictor order, which is usually 10 for 8 kHz sampled speech. Many known predictive speech codecs fit this description, including codecs using Adaptive Predictive Coding (APC), Multi-Pulse Linear Predictive Coding (MPLPC), Code-Excited Linear Prediction (CELP), and Noise Feedback Coding (NFC).

The example arrangement of filter controller 102 depicted in FIG. 2A includes blocks 220–290. Speech decoder 101 can be considered external to the filter controller. As mentioned above, speech decoder 101 decodes the incoming bit stream into DS signal $\tilde{s}(n)$. Assume the decoder 101 has the decoded LPC predictor coefficients $\hat{a}_i$, i=1, 2, . . . , M available (note that $\hat{a}_0$=1 as always). In the frequency-domain, the DS signal $\tilde{s}(n)$ has a spectral envelope including a first plurality of formant peaks. Typically, the formant peaks have different respective amplitudes spread over a wide dynamic range.

A bandwidth expansion block 220 scales these $\hat{a}_i$ coefficients to produce coefficients 222 of a shaping filter block 230 that has a transfer function of $$\hat{A}(z/\alpha) = \sum_{i=0}^{M} (\hat{a}_i \alpha^i) z^{-1}.$$

A suitable value for $\alpha$ is 0.90.

Alternatively, one can use the example arrangement of filter controller 102 depicted in FIG. 2B to derive the coefficients of the shaping filter (block 230). The filter controller of FIG. 2B includes blocks or modules 215–290. Rather than performing bandwidth expansion of the decoded LPC predictor coefficients $\hat{a}_i$, i=1, 2, . . . , M, the controller of FIG. 2B includes block 215 to perform an LPC analysis to derive the LPC predictor coefficients from the decoded speech signal, and then uses a bandwidth expansion block 220 to perform bandwidth expansion on the resulting set of LPC predictor coefficients. This alternative method (that is, the method depicted in FIG. 2B) is useful if the speech decoder 101 does not provide decoded LPC predictor coefficients, or if such decoded LPC predictor coefficients are deemed unreliable. Note that except for the addition of block 215, the controller of FIG. 2B is otherwise identical to the controller of FIG. 2A. In other words, each of the functional blocks in FIG. 2A is identical to the corresponding functional block in FIG. 2B having the same block number.

An all-zero shaping filter 230, having transfer function $\hat{A}(z/\alpha)$, then filters the decoded speech signal $\tilde{s}(n)$ to get an output signal f(n), where signal f(n) is a time-domain signal. This shaping filter $\hat{A}(z/\alpha)$ (230) will remove most of the spectral tilt in the spectral envelope of the decoded speech signal $\tilde{s}(n)$, while preserving the formant structure in the spectral envelope of the filtered signal f(n). However, there is still some remaining spectral tilt.

More generally, in the frequency-domain, signal f(n) has a spectral envelope including a plurality of formant peaks corresponding to the plurality of formant peaks of the spectral envelope of DS signal $\tilde{s}(n)$. One or more amplitude differences between the formant peaks of the spectral envelope of signal f(n) are reduced relative to one or more amplitude differences between corresponding formant peaks of the spectral envelope of DS signal $\tilde{s}(n)$ . Thus, signal f(n) is "spectrally-flattened" relative to decoded speech $\tilde{s}(n)$ .

A low-order spectral tilt compensation filter 260 is then used to further remove the remaining spectral tilt. Let the order of this filter be K. To derive the coefficients of this filter, a block 240 performs a Kth-order LPC analysis on the signal f(n), resulting in a Kth-order LPC prediction error filter defined by $$B(z) = \sum_{i=0}^{K} b_i z^{-1}$$

A suitable filter order is K=1 or 2. Good result is obtained by using a simple autocorrelation LPC analysis with a rectangular window over the current sub-frame of f(n).

A block 250, following block 240, then performs a well-known bandwidth expansion procedure on the coefficients of B(z) to obtain the spectral tilt compensation filter (block 260) that has a transfer function of $$B(z/\delta) = \sum_{i=0}^{K} (b_i\delta^1)z^{-1}.$$

For the parameter values chosen above, a suitable value for δ is 0.96.

The signal f(n) is passed through the all-zero spectral tilt compensation filter B(z/δ) (260). Filter 260 filters spectrally-flattened signal f(n) to reduce amplitude differences between formant peaks in the spectral envelope of signal f(n). The resulting filtered output of block 260 is denoted as signal t(n). Signal t(n) is a time-domain signal, that is, signal t(n) includes a series of temporally related signal samples. Signal t(n) has a spectral envelope including a plurality of formant peaks corresponding to the formant peaks in the spectral envelopes of signals f(n) and DS signal s̃(n) . The formant peaks of signal t(n) approximately coincide in frequency with the formant peaks of DS signal s̃(n). Amplitude differences between the formant peaks of the spectral envelope of signal t(n) are substantially reduced relative to the amplitude differences between corresponding formant peaks of the spectral envelope of DS signal s̃(n). Thus, signal t(n) is "spectrally-flattened" with respect to DS signal s̃(and also relative to signal f(n)). The formant peaks of spectrally-flattened time-domain signal t(n) have respective amplitudes (referred to as formant amplitudes) that are approximately equal to each other (for example, within 3 dB of each other), while the formant amplitudes of DS signal s̃(n) may differ substantially from each other (for example, by as much as 30 dB).

For these reasons, the spectral envelope of signal t(n) has very little spectral tilt left, but the formant peaks in the decoded speech are still mostly preserved. Thus, a primary purpose of blocks 230 and 260 is to make the formant peaks in the spectrum of s̃(n) become approximately equal-magnitude spectral peaks in the spectrum of t(n) so that a desirable short-term postfilter can be derived from the signal t(n) . In the process of making the spectral peaks of t(n) roughly equal magnitude, the spectral tilt of t(n) is advantageously reduced or minimized.

An analysis block 270 then performs a higher order LPC analysis on the spectrally-flattened time-domain signal t(n), to produce coefficients $a_i$. In an embodiment, the coefficients $a_i$ are produced without performing a time-domain to frequency-domain conversion. An alternative embodiment may include such a conversion. The resulting LPC synthesis filter has a transfer function of $$\frac{1}{A(z)} = \frac{1}{\sum_{i=0}^{L} a_i z^{-1}}.$$

Here the filter order L can be, but does not have to be, the same as M, the order of the LPC synthesis filter in the speech decoder. The typical value of L is 10 or 8 for 8 kHz sampled speech.

This all-pole filter has a frequency response with spectral peaks located approximately at the frequencies of formant peaks of the decoded speech. The spectral peaks have respective levels on approximately the same level, that is, the spectral peaks have approximately equal respective amplitudes (unlike the formant peaks of speech, which have amplitudes that typically span a large dynamic range). This is because the spectral tilt in the decoded speech signal s̃(n) has been largely removed by the shaping filter Â(z/α) (230) and the spectral tilt compensation filter B(z/δ) (260). The coefficients $a_i$ may be used directly to establish a filter for filtering the decoded speech signal s̃(n) . However, subsequent processing steps, performed by blocks 280 and 290, modify the coefficients, and in doing so, impart desired properties to the coefficients $a_i$, as will become apparent from the ensuing description.

Next, a bandwidth expansion block 280 performs bandwidth expansion on the coefficients of the all-pole filter $$\frac{1}{A(z)}$$

to control the amount of short-term postfiltering. After the bandwidth expansion, the resulting filter has a transfer function of $$\frac{1}{A(z/\theta)} = \frac{1}{\sum_{i=0}^{L} (a_i\theta^i)z^{-1}}.$$

A suitable value of θ may be in the range of 0.60 to 0.75, depending on how noisy the decoded speech is and how much noise reduction is desired. A higher value of θ provides more noise reduction at the risk of introducing more noticeable postfiltering distortion, and vice versa.

To ensure that such a short-term postfilter evolves from sub-frame to sub-frame in a smooth manner, it is useful to smooth the filter coefficients $\tilde{a}_i = a_i\theta^i$, i=1, 2, . . . , L using a first-order all-pole lowpass filter. Let $\tilde{a}_i(k)$ denote the i-th coefficient $\tilde{a}_i = a_i\theta^i$ in the k-th sub-frame, and let $d_i(k)$ denote its smoothed version. A coefficient smoothing block 290 performs the following lowpass smoothing operation $$d_i(k) = \rho d_i(k-1) + (1-\rho)\tilde{a}_i(k), \text{ for } i = 1, 2, \ldots, L.$$

A suitable value of ρ is 0.75.

Suppressing the sub-frame index k, for convenience, yields the resulting all-pole filter with a transfer function of $$\frac{1}{D(z)} = \frac{1}{\sum_{i=0}^{L} d_i z^{-1}}$$

as the final short-term postfilter used in an embodiment of the present invention. It is found that with θ between 0.60 and 0.75 and with ρ=0.75, this single all-pole short-term postfilter gives lower average spectral tilt than a conventional short-term postfilter.

The smoothing operation, performed in block 290, to obtain the set of coefficients $d_i$ for i=1, 2, . . . , L is basically a weighted average of two sets of coefficients for two all-pole filters. Even if these two all-pole filters are individually stable, theoretically the weighted averages of these two sets of coefficients are not guaranteed to give a stable all-pole filter. To guarantee stability, theoretically one has to calculate the impulse responses of the two all-pole filters, calculate the weighted average of the two impulse responses, and then implement the desired short-term postfilter as an all-zero filter using a truncated version of the weighted average of impulse responses. However, this will increase computational complexity significantly, as the order of the resulting all-zero filter is usually much higher than the all-pole filter order L.

In practice, it is found that because the poles of the filter $$\frac{1}{A(z/\theta)}$$

are already scaled to be well within the unit circle (that is, far away from the unit circle boundary), there is a large "safety margin", and the smoothed all-pole filter $$\frac{1}{D(z)}$$

is always stable in our observations. Therefore, for practical purposes, directly smoothing the all-pole filter coefficients $\tilde{a}_i = a_i\theta^i$, i=1, 2, . . . , L does not cause instability problems, and thus is used in an embodiment of the present invention due to its simplicity and lower complexity.

To be even more sure that the short-term postfilter will not become unstable, then the approach of weighted average of impulse responses mentioned above can be used instead. With the parameter choices mentioned above, it has been found that the impulse responses almost always decay to a negligible level after the $16^{th}$ sample. Therefore, satisfactory results can be achieved by truncating the impulse response to 16 samples and use a $15^{th}$-order FIR (all-zero) short-term postfilter.

Another way to address potential instability is to approximate the all-pole filter $$\frac{1}{A(z/\theta)} \text{ or } \frac{1}{D(z)}$$

by an all-zero filter through the use of Durbin's recursion. More specifically, the autocorrelation coefficients of the all-pole filter coefficient array $\tilde{a}_i$ or $d_i$ for i=0, 1, 2, . . . , L can be calculated, and Durbin's recursion can be performed based on such autocorrelation coefficients. The output array of such Durbin's recursion is a set of coefficients for an FIR (all-zero) filter, which can be used directly in place of the all-pole filter $$\frac{1}{A(z/\theta)} \text{ or } \frac{1}{D(z)}.$$

Since it is an FIR filter, there will be no instability. If such an FIR filter is derived from the coefficients of $$\frac{1}{A(z/\theta)},$$

further smoothing may be needed, but if it is derived from the coefficients of $$\frac{1}{D(z)},$$

then additional smoothing is not necessary.

Note that in certain applications, the coefficients of the short-term synthesis filter $$H(z) = \frac{1}{\hat{A}(z)}$$

may not have sufficient quantization resolution, or may not be available at all at the decoder (e.g. in a non-predictive codec). In this case, a separate LPC analysis can be performed on the decoded speech $\tilde{s}(n)$ to get the coefficients of $\hat{A}(z)$. The rest of the procedures outlined above will remain the same.

It should be noted that in the conventional short-term postfilter of G.729 shown in FIG. 1B, there are two adaptive scaling factors $G_s$ and $G_t$ for the pole-zero filter and the first-order spectral tilt compensation filter, respectively. The calculation of these scaling factors is complicated. For example, the calculation of $G_s$ involves calculating the impulse response of the pole-zero filter $$\frac{\hat{A}(z/\beta)}{\hat{A}(z/\alpha)},$$

taking absolute values, summing up the absolute values, and taking the reciprocal. The calculation of $G_t$ also involves absolute value, subtraction, and reciprocal. In contrast, no such adaptive scaling factor is necessary for the short-term postfilter of the present invention, due to the use of a novel overlap-add procedure later in the postfilter structure.

EXAMPLE SPECTRAL PLOTS FOR THE FILTER CONTROLLER

Figure 2C:
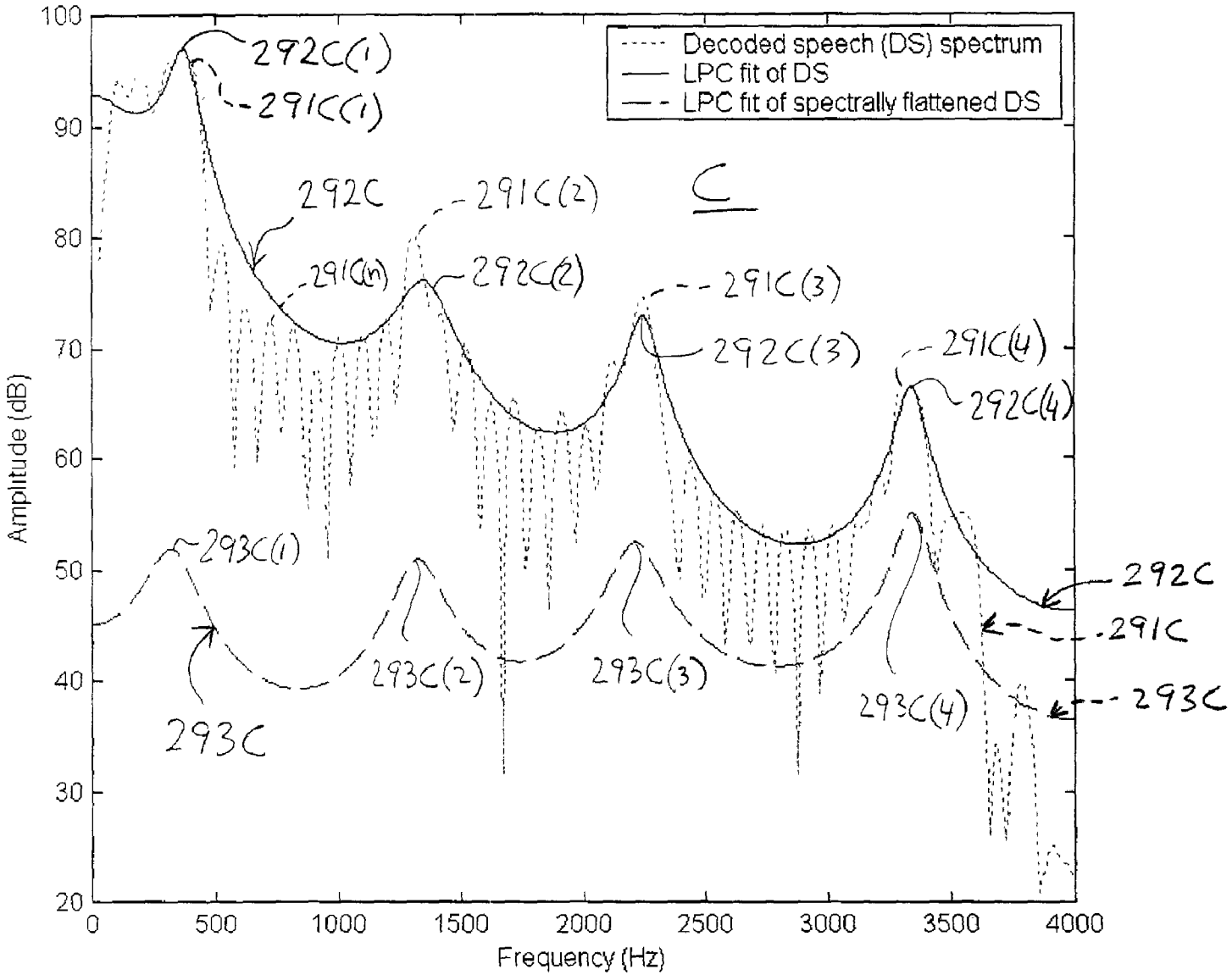
FIGS. 2C, 2D and 2E each include illustrations of a decoded speech spectrum and filter responses related to the filter controller of FIG. 1A.

FIG. 2C is a first set of three example spectral plots C related to filter controller 102, resulting from a first example DS signal $\tilde{s}(n)$ corresponding to the "oe" portion of the word "canoe" spoken by a male. Response set C includes a frequency spectrum, that is, a spectral plot, 291C (depicted in short-dotted line) of DS signal $\tilde{s}(n)$, corresponding to the "oe" portion of the word "canoe" spoken by a male. Spectrum 291C has a formant structure including a plurality of spectral peaks 291C(1)–(n). The most prominent spectral peaks 291C(1), 291C(2), 291C(3) and 291C(4), have different respective formant amplitudes. Overall, the formant amplitudes are monotonically decreasing. Thus, spectrum 291C has/exhibits a low-pass spectral tilt.

Response set C also includes a spectral envelope 292C (depicted in solid line) of DS signal $\tilde{s}(n)$, corresponding to frequency spectrum 291C. Spectral envelope 292C is the LPC spectral fit of DS signal $\tilde{s}(n)$ . In other words, spectral envelope 292C is the filter frequency response of the LPC filter represented by coefficients $\hat{a}_i$ (see FIGS. 2A and 2B). Spectral envelope 292C includes formant peaks 292C(1)

–292C(4) corresponding to, and approximately coinciding in frequency with, formant peaks 291C(1)–291C(4). Spectral envelope 292C follows the general shape of spectrum 291C, and thus exhibits the low-pass spectral tilt. The formant amplitudes of spectrums 291C and 292C have a dynamic range (that is, maximum amplitude difference) of approximately 30 dB. For example, the amplitude difference between the minimum and maximum formant amplitudes 292C(4) and 292C(1) is within in this range.

Response set C also includes a spectral envelope 293C (depicted in long-dashed line) of spectrally-flattened signal t(n), corresponding to frequency spectrum 291C. Spectral envelope 293C is the LPC spectral fit of spectrally-flattened DS signal t(n). In other words, spectral envelope 293C is the fithe filter frequency response of the LPC filter represented by coefficients $a_i$ in FIGS. 2A and 2B, corresponding to spectrally-flattened signal t(n). Spectral envelope 293C includes formant peaks 293C(1)–293C(4) corresponding to, and approximately coinciding in frequency with, respective ones of formant peaks 291C(1)–(4) and 292C(1)–(4) of spectrums 291C and 292C. However, the formant peaks 293(1)–293(4) of spectrum 293C have approximately equal amplitudes. That is, the formant amplitudes of spectrum 293C are approximately equal to each other. For example, while the formant amplitudes of spectrums 291C and 292C have a dynamic range of approximately 30 dB, the formant amplitudes of spectrum 293C are within approximately 3 dB of each other.

Figure 2D:
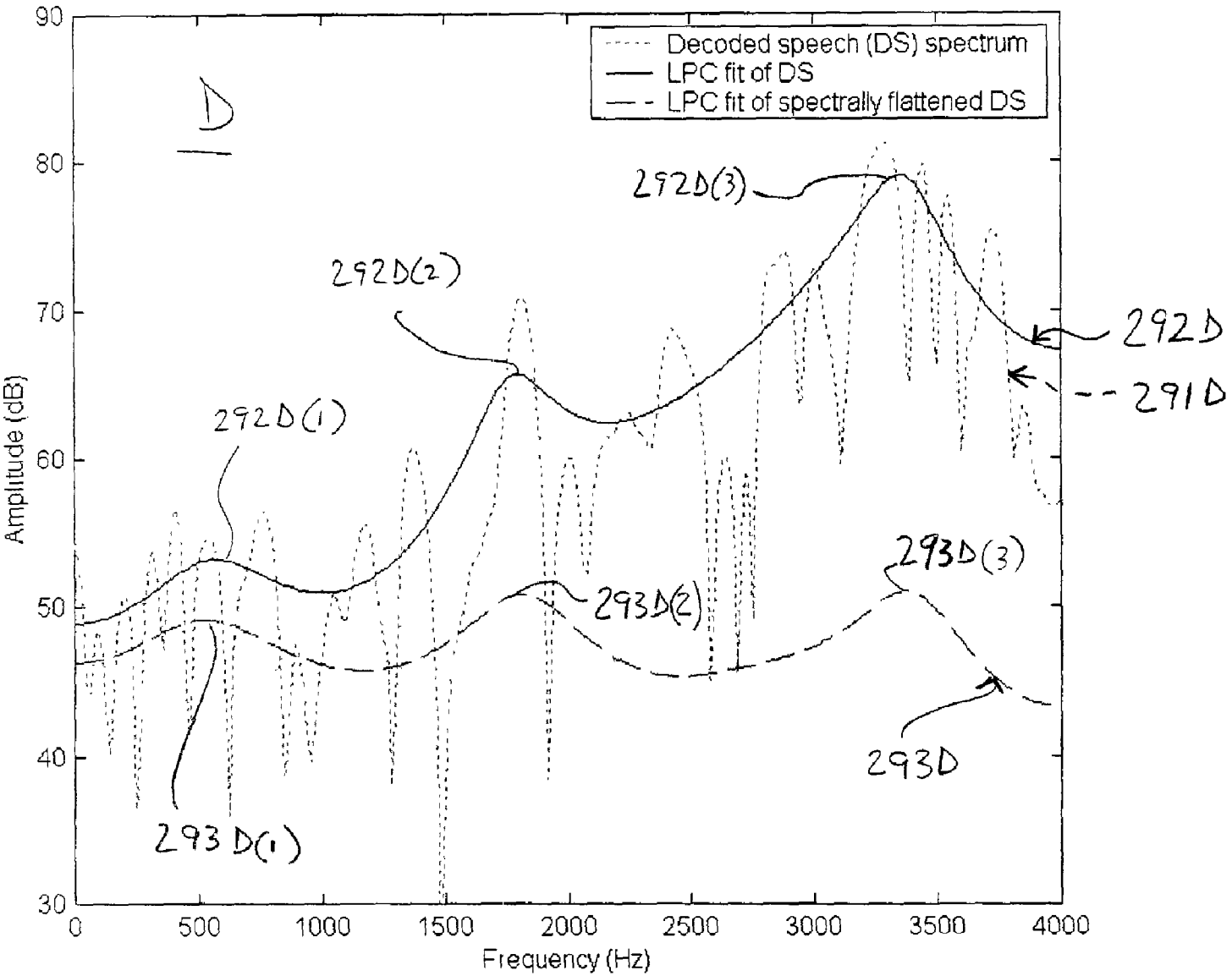

FIG. 2D is a second set of three example spectral plots D related to filter controller 102, resulting from a second example DS signal s(n) corresponding to the "sh" portion of the word "fish" spoken by a male. Response set D includes a spectrum 291D of DS signal $\tilde{s}(n)$, a spectral envelope 292D of the DS signal $\tilde{s}(n)$ corresponding to spectrum 291D, and a spectral envelope 293D of spectrally-flattened signal t(n). Spectrums 291D and 292D are similar to spectrums 291C and 292C of FIG. 2C, except spectrums 291D and 292D have monotonically increasing formant amplitudes. Thus, spectrums 291D and 292D have high-pass spectral tilts, instead of low-pass spectral tilts. On the other hand, spectral envelope 293D includes formant peaks having approximately equal respective amplitudes.

Figure 2E:
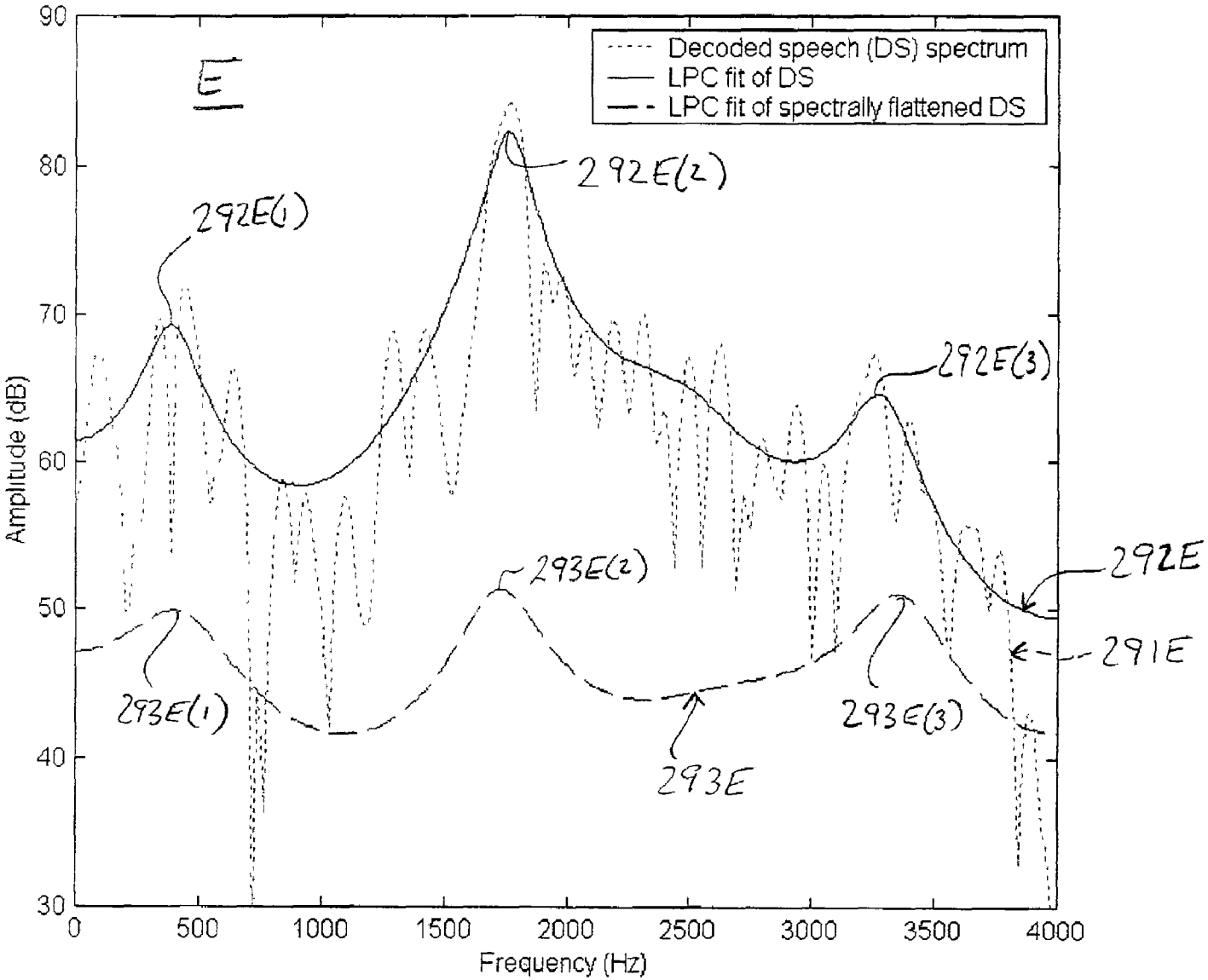

FIG. 2E is a third set of three example spectral plots E related to filter controller 102, resulting from a third example DS signal s(n) corresponding to the "c" (/k/ sound) of the word "canoe" spoken by a male. Response set E includes a spectrum 291E of DS signal $\tilde{s}(n)$, a spectral envelope 292E of the DS signal $\tilde{s}(n)$ corresponding to spectrum 291E, and a spectral envelope 293E of spectrally-flattened signal t(n). Unlike spectrums 291C and 292C, and 291D and 292D discussed above, the formant amplitudes in spectrums 291E and 292E do not exhibit a clear spectral tilt. Instead, for example, the peak amplitude of the second formant 292D(2) is higher than that of the first and the third formant peaks 292D(1) and 292D(3), respectively. Nevertheless, spectral envelope 293E includes formant peaks having approximately equal respective amplitudes.

It can be seen from example FIGS. 2C–2E, that the formant peaks of the spectrally-flattened DS signal t(n) have approximately equal respective amplitudes for a variety of different formant structures of the input spectrum, including input formant structures having a low-pass spectral tilt, a high-pass spectral tilt, a large formant peak between two small formant peaks, and so on.

Returning again to FIG. 1A, and FIGS. 2A and 2B, the filter controller of the present invention can be considered to include a first stage 294 followed by a second stage 296. First stage 294 includes a first arrangement of signal processing blocks 220–60 in FIG. 2A, and second arrangement of signal processing blocks 215–260 in FIG. 2B. Second stage 296 includes blocks 270–290. As described above, DS signal $\tilde{s}(n)$ has a spectral envelope including a first plurality of formant peaks (e.g., 291C(1)–(4)). The first plurality of formant peaks typically have substantially different respective amplitudes. First stage 294 produces, from DS signal $\tilde{s}(n)$, spectrally-flattened DS signal t(n) as a time-domain signal (for example, as a series of time-domain signal samples). Spectrally-flattened time-domain DS signal t(n) has a spectral envelope including a second plurality of formant peaks (e.g., 293C(1)–(4)) corresponding to the first plurality of formant peaks of DS signal $\tilde{s}(n)$ . The second plurality of formant peaks have respective amplitudes that are approximately equal to each other.

Second stage 296 derives the set of filter coefficients $d_i$ from spectrally-flattened time-domain DS signal t(n). Filter coefficients $d_i$ represent a filter response, realized in short-term filter 104, for example, having a plurality of spectral peaks approximately coinciding in frequency with the formant peaks of the spectral envelope of DS signal $\tilde{s}(n)$ . The filter peaks have respective magnitudes that are approximately equal to each other.

Filter 103 receives filter coefficients $d_i$. Coefficients $d_i$ cause short-term filter 104 to have the above-described filter response. Filter 104 filters DS signal $\tilde{s}(n)$ (or a long-term filtered version thereof in embodiments where long-term filtering precedes short-term filtering) using coefficients $d_i$, and thus, in accordance with the above-described filter response. As mentioned above, the frequency response of filter 104 includes spectral peaks of approximately equal amplitude, and coinciding in frequency with the formant peaks of the spectral envelope of DS signal $\tilde{s}(n)$ . Thus, filter 103 advantageously maintains the relative amplitudes of the formant peaks of the spectral envelope of DS signal $\tilde{s}(n)$, while deepening spectral valleys between the formant peaks. This preserves the overall formant structure of DS signal $\tilde{s}(n)$, while reducing coding noise associated with the DS signal (that resides in the spectral valleys between the formant peaks in the DS spectral envelope).

In an embodiment, filter coefficients $d_i$ are all-pole short-term filter coefficients. Thus, in this embodiment, short-term filter 104 operates as an all-pole short-term filter. In other embodiments, the short-term filter coefficients may be derived from signal t(n) as all-zero, or pole-zero coefficients, as would be apparent to one of ordinary skill in the relevant art(s) after having read the present description.

3. Long-Term Postfilter

Importantly, the long-term postfilter of the present invention (for example, long-term filter 105) does not use an adaptive scaling factor, due to the use of a novel overlap-add procedure later in the postfilter structure. It has been demonstrated that the adaptive scaling factor can be eliminated from the long-term postfilter without causing any audible difference.

Let p denote the pitch period for the current sub-frame For the long-term postfilter, the present invention can use an all-zero filter of the form $1+\gamma z^{-p}$, an all-pole filter of the form $$\frac{1}{1-\lambda z^{-p}},$$

or a pole-zero filter of the form $$\frac{1+\gamma z^{-p}}{1-\lambda z^{-p}}.$$

In the transfer functions above, the filter coefficients γ and λ are typically positive numbers between 0 and 0.5.

In a predictive speech codec, the pitch period information is often transmitted as part of the side information. At the decoder, the decoded pitch period can be used as is for the long-term postfilter. Alternatively, a search of a refined pitch period in the neighborhood of the transmitted pitch may be conducted to find a more suitable pitch period. Similarly, the coefficients γ and λ are sometimes derived from the decoded pitch predictor tap value, but sometimes re-derived at the decoder based on the decoded speech signal. There may also be a threshold effect, so that when the periodicity of the speech signal is too low to justify the use of a long-term postfilter, the coefficients γ and λ are set to zero. All these are standard practices well known in the prior art of long-term postfilters , and can be used with the long-term postfilter in the present invention.

4. Overall Postfilter Structure

FIG. 3 is a block diagram of an example arrangement 300 of adaptive postfilter 103. In other words, postfilter 300 in FIG. 3 expands on postfilter 103 in FIG. 1A. Postfilter 300 includes a long-term postfilter 310 (corresponding to long-term filter 105 in FIG. 1A) followed by a short-term postfilter 320 (corresponding to short-term filter 104 in FIG. 1A). When compared against the conventional postfilter structure of FIG. 1, one noticeable difference is the lack of separate gain scaling factors for long-term postfilter 310 and short-term postfilter 320 in FIG. 3. Another important difference is the lack of sample-by-sample smoothing of an AGC scaling factor G in FIG. 3. The elimination of these processing blocks is enabled by the addition of an overlap-add block 350, which smoothes out waveform discontinuity at the sub-frame boundaries.

Adaptive postfilter 300 in FIG. 3 is depicted with an all-zero long-term postfilter (310). FIG. 4 shows an alternative adaptive postfilter arrangement 400 of filter 103, with an all-pole long-term postfilter 410. The function of each processing block in FIG. 3 is described below. It is to be understood that FIGS. 3 and 4 also represent respective methods of filtering a signal. For example, each of the functional blocks, or groups of functional blocks, depicted in FIGS. 3 and 4 perform one or more method steps of an overall method of filtering a signal.

Let $\tilde{s}(n)$ denote the n-th sample of the decoded speech. Filter block 310 performs all-zero long-term postfiltering as follows to get the long-term postfiltered signal $s_l(n)$ defined as $$s_l(n)=\tilde{s}(n)+\gamma\tilde{s}(n-p).$$

Filter block 320 then performs short-term a postfiltering operation on $s_l(n)$ to obtain the short-term postfiltered signal $s_s(n)$ given by $$s_s(n)=s_l(n)-\sum_{i=1}^{L} d_i s_s(n-i).$$

Once a sub-frame, a gain scaler block 330 measures an average "gain" of the decoded speech signal $\tilde{s}(n)$ and the short-term postfiltered signal $s_s(n)$ in the current sub-frame, and calculates the ratio of these two gains. The "gain" can be determined in a number of different ways. For example, the gain can be the root-mean-square (RMS) value calculated over the current sub-frame. To avoid the square root operation and keep the computational complexity low, an embodiment of gain scaler block 330 calculates the once-a-frame AGC scaling factor G as $$G=\frac{\sum_{n=1}^{N}|\tilde{s}(n)|}{\sum_{n=1}^{N}|s_s(n)|},$$

where N is the number of speech samples in a sub-frame, and the time index n =1, 2, . . . , N corresponds to the current sub-frame.

Block 340 multiplies the current sub-frame of short-term postfiltered signal $s_s(n)$ by the once-a-frame AGC scaling factor G to obtain the gain-scaled postfiltered signal $s_g(n)$, as in $$s_g(n)=G\,s_g(n),\ \text{for } n=1, 2, \ldots, N.$$

5. Frame Boundary Smoothing

Block 350 performs a special overlap-add operation as follows. First, at the beginning of the current sub-frame, it performs the operations of blocks 310, 320, and 340 for J samples using the postfilter parameters (γ, p, and $d_i$, i=1, 2, . . . , L) and AGC gain G of the last sub-frame, where J is the number of samples for the overlap-add operation, and J≦N. This is equivalent to letting the operations of blocks 310, 320, and 340 of the last sub-frame to continue for additional J samples into the current sub-frame without updating the postfilter parameters and AGC gain. Let the resulting J samples of output of block 340 be denoted as $s_p(n)$, n=1, 2, . . . , J. Then, these J waveform samples of the signal $s_p(n)$ are essentially a continuation of the $s_g(n)$ signal in the last sub-frame, and therefore there should be a smooth transition across the boundary between the last sub-frame and the current sub-frame. No waveform discontinuity should occur at this sub-frame boundary.

Let $w_d(n)$ and $w_u(n)$ denote the overlap-add window that is ramping down and ramping up, respectively. The overlap-add block 350 calculates the final postfilter output speech signal $s_f(n)$ as follows:

$$s_f(n)=\begin{cases} w_d(n)s_p(n)+w_u(n)s_g(n), & \text{for } 1\le n\le J \\ s_g(n), & \text{for } J<n\le N \end{cases}$$

In practice, it is found that for a sub-frame sizb 40 samples (5 ms for 8 kHz sampling), satisfactory results were obtained with an overlap-add length of J=20 samples. The overlap-add window functions $W_d(n)$ and $w_u(n)$ can be any of the well-known window functions for the overlap-add operation. For example, they can both be raised-cosine windows or both be triangular windows, with the requirement that $w_d(n)+w_u(n)=1$ for n=1, 2, . . . , J. It is found that the simpler triangular windows work satisfactorily.

Note that at the end of a sub-frame, the final postfiltered speech signal $s_f(n)$ is identical to the gain-scaled signal $s_g(n)$. Since the signal $s_p(n)$ is a continuation of the signal $s_g(n)$ of the last sub-frame, and since the overlap-add operation above causes the final postfiltered speech signal $s_f(n)$ to make a gradual transition from $s_p(n)$ to $s_g(n)$ in the first J samples of the current sub-frame, any waveform discontinuity in the signal $s_g(n)$ that may exist at the sub-frame boundary (where n=1) will be smoothed out by the overlap-add operation. It is this smoothing effect provided by the overlap-add block 350 that allowed the elimination of the individual gain scaling factors for long-term and short-term postfilters, and the sample-by-sample smoothing of the AGC scaling factor.

The AGC unit of conventional postfilters (such as the one in FIG. 1B) attempts to have a smooth sample-by-sample evolution of the gain scaling factor, so as to avoid perceived discontinuity in the output waveform. There is always a trade-off in such smoothing. If there is not enough smoothing, the output speech may have audible discontinuity, sometimes described as crackling noise. If there is too much smoothing, on the other hand, the AGC gain scaling factor may adapt in a very sluggish manner—so sluggish that the magnitude of the postfiltered speech may not be able to keep up with the rapid change of magnitude in certain parts of the unfiltered decoded speech.

In contrast, there is no such "sluggishness" of gain tracking in the present invention. Before the overlap-add operation, the gain-scaled signal $s_g(n)$ is guaranteed to have the same average "gain" over the current sub-frame as the unfiltered decoded speech, regardless of how the "gain" is defined. Therefore, on a sub-frame level, the present invention will produce a final postfiltered speech signal that is completely "gain-synchronized" with the unfiltered decoded speech. The present invention will never have to "chase after" the sudden change of the "gain" in the unfiltered signal, like previous postfilters do.

Figure 5:
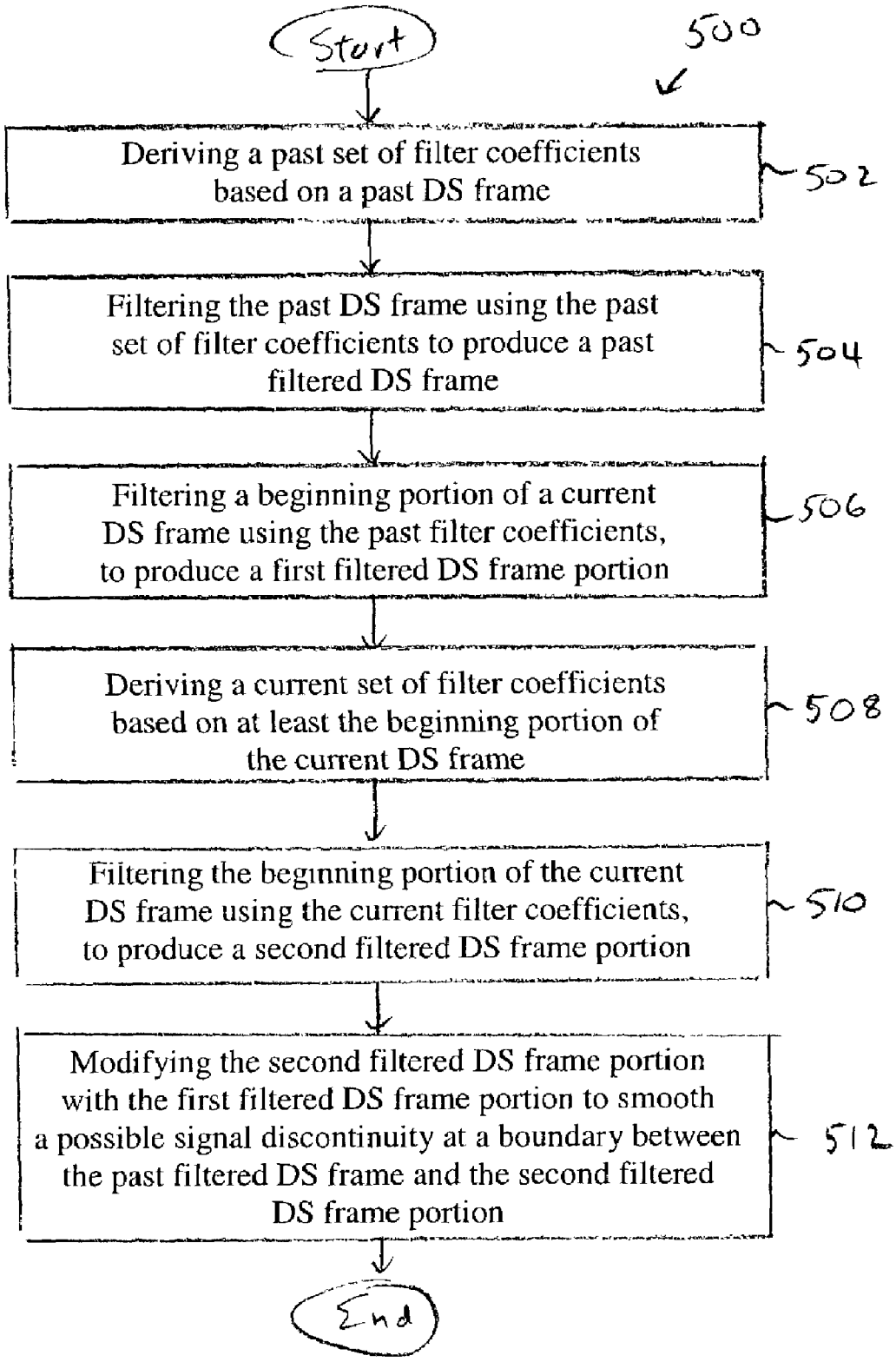
FIG. 5 is a flow chart of an example method of adaptively filtering a decoded speech signal to smooth signal discontinuities that may arise from a filter update at a speech frame boundary.

FIG. 5 is a flow chart of an example method 500 of adaptively filtering a DS signal including successive DS frames (where each frame includes a series of DS samples), to smooth, and thus, substantially eliminate, signal discontinuities that may arise from a filter update at a DS frame boundary. Method 500 is also be referred to as a method of smoothing an adaptively filtered DS signal.

An initial step 502 includes deriving a past set of filter coefficients based on at least a portion of a past DS frame. For example, step 502 may include deriving short-term filter coefficients $d_i$ from a past DS frame.

A next step 504 includes filtering the past DS frame using the past set of filter coefficients to produce a past filtered DS frame.

A next step 506 includes filtering a beginning portion or segment of a current DS frame using the past filter coefficients, to produce a first filtered DS frame portion or segment. For example, step 506 produces a first filtered frame portion represented as signal $s_p(n)$ for n=1 . . . J, in the manner described above.

A next step 508 includes deriving a current set of filter coefficients based on at least a portion, such as the beginning portion, of the current DS frame.

A next step 510 includes filtering the beginning portion or segment of the current DS frame using the current filter coefficients, thereby producing a second filtered DS frame portion. For example, step 510 produces a second filtered frame portion represented as signal $s_g(n)$ for n=1 . . . J, in the manner described above.

A next step 512 (performed by blocks 350 and 450 in FIGS. 3 and 4, for example) includes modifying the second filtered DS frame portion with the first filtered DS frame portion, so as to smooth a possible signal discontinuity at a boundary between the past filtered DS frame and the current filtered DS frame . For example, step 512 performs the following operation, in the manner described above:

$$s_f(n)=w_d(n)s_p(n)+w_u(n)s_g(n),\ n=1,\ 2,\ldots,N.$$

In method 500, steps 506, 510 and 512 result in smoothing the possible filtered signal waveform discontinuity that can arise from switching filter coefficients at a frame boundary.

All of the filtering steps in method 500 (for example, filtering steps 504, 506 and 510) may include short-term filtering or long-term filtering, or a combination of both. Also, the filtering steps in method 500 may include short-term and/or long-term filtering, followed by gain-scaling.

Method 500 may be applied to any signal related to a speech and/or audio signal. Also, method 500 may be applied more generally to adaptive filtering (including both postfiltering and non-postfiltering) of any signal, including a signal that is not related to speech and/or audio signals.

6. Further Embodiments

FIG. 4 shows an alternative adaptive postfilter structure according to the present invention. The only difference is that the all-zero long-term postfilter 310 in FIG. 3 is now replaced by an all-pole long-term postfilter 410. This all-pole long-term postfilter 410 performs long-term postfiltering according to the following equation.

$$s_l(n)=\tilde{s}(n)+\lambda s_l(n-p)$$

The functions of the remaining four blocks in FIG. 4 are identical to the similarly numbered four blocks in FIG. 3.

As discussed in Section 2.2 above, alternative forms of short-term postfilter other than $$\frac{1}{D(z)},$$

namely the FIR (all-zero) versions of the short-term postfilter, can also be used. Although FIGS. 3 and 4 only shows $$\frac{1}{D(z)}$$

as the short-term postfilter, it is to be understood that any of the alternative all-zero short-term postfilters mentioned in Section 2.2 can also be used in the postfilter structure depicted in FIGS. 3 and 4. In addition, even though the short-term postfilter is shown to be following the long-term postfilter in FIGS. 3 and 4, in practice the order of the short-term postfilter and long-term postfilter can be reversed without affecting the output speech quality. Also, the postfilter of the present invention may include only a short-term filter (that is, a short-term filter but no long-term filter) or only a long-term filter.

Yet another alternative way to practice the present invention is to adopt a "pitch prefilter" approach used in a known decoder, and move the long-term postfilter of FIG. 3 or FIG. 4 before the LPC synthesis filter of the speech decoder. However, in this case, an appropriate gain scaling factor for the long-term postfilter probably would need to be used, otherwise the LPC synthesis filter output signal could have a signal gain quite different from that of the unfiltered decoded speech. In this scenario, block 330 and block 430 could use the LPC synthesis filter output signal as the reference signal for determining the appropriate AGC gain factor.

7. Generalized Adaptive Filtering Using Overlap-Add

Figure 6:
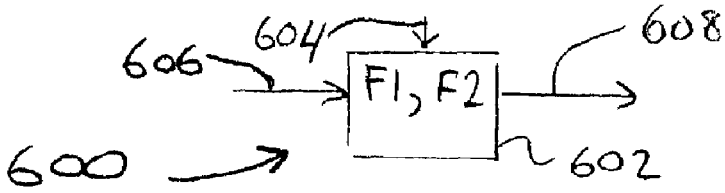
FIG. 6 is a high-level block diagram of an example adaptive filter.

As mentioned above, the overlap-add method described may be used in adaptive filtering of any type of signal. For example, an adaptive filter can use components of the overlap-add method described above to filter any signal. FIG. 6 is a high-level block diagram of an example generalized adaptive or time-varying filter 600. The term "generalized" is meant to indicate that filter 600 can filter any type of signal, and that the signal need not be segmented into frames of samples.

In response to a filter control signal 604, adaptive filter 602 switches between successive filters. For example, in response to filter control signal 604, adaptive filter 602 switches from a first filter F1 to a second filter F2 at a filter update time $t_U$. Each filter may represent a different filter transfer function (that is, frequency response), level of gain scaling, and so on. For example, each different filter may result from a different set of filter coefficients, or an updated gain present in control signal 604. In one embodiment, the two filters F1 and F2 have the exact same structures, and the switching involves updating the filter coefficients from a first set to a second set, thereby changing the transfer characteristics of the filter. In an alternative embodiment, the filters may even have different structures and the switching involves updating the entire filter structure including the filter coefficients. In either case this is referred as switching from a first filter F1 to a second filter F2. This can also be thought of as switching between different filter variations F1 and F2.

Adaptive filter 602 filters a generalized input signal 606 in accordance with the successive filters, to produce a filtered output signal 608. Adaptive filter 602 performs in accordance with the overlap-add method described above, and further below.

Figure 7:
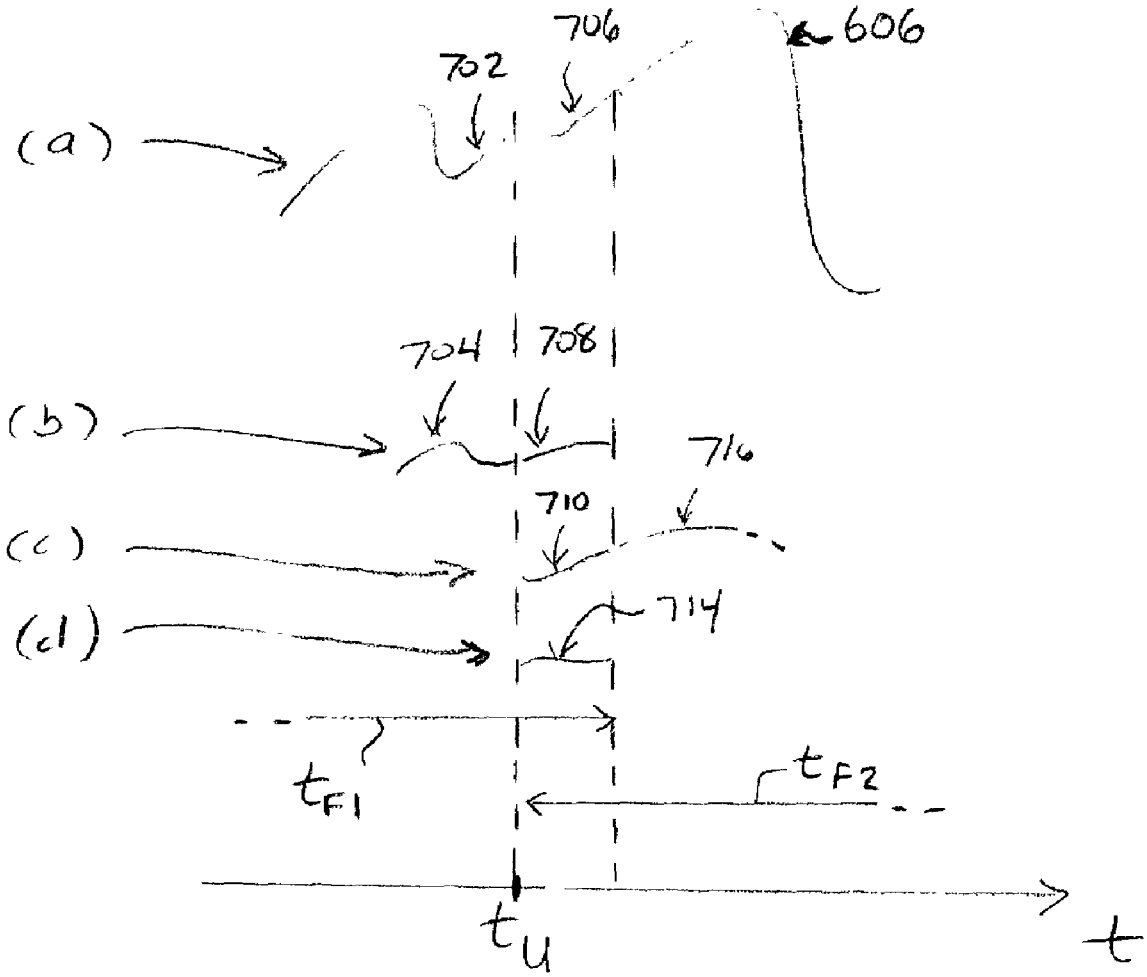
FIG. 7 is a timing diagram for example portions of various signals discussed in connection with the filter of FIG. 7.

FIG. 7 is a timing diagram of example portions (referred to as waveforms (a) through (d)) of various signals relating to adaptive filter 600, and to be discussed below. These various signals share a common time axis. Waveform (a) represents a portion of input signal 606. Waveform (b) represents a portion of a filtered signal produced by filter 600 using filter F1. Waveform (c) represents a portion of a filtered signal produced by filter 600 using filter F2. Waveform (d) represents the overlap-add output segment, a portion of the signal 608, produced by filter 600 using the overlap-add method of the present invention. Also represented in FIG. 7 are time periods $t_{F1}$ and $t_{F2}$ representing time periods during which filter F1 and F2 are active, respectively.

Figure 8:
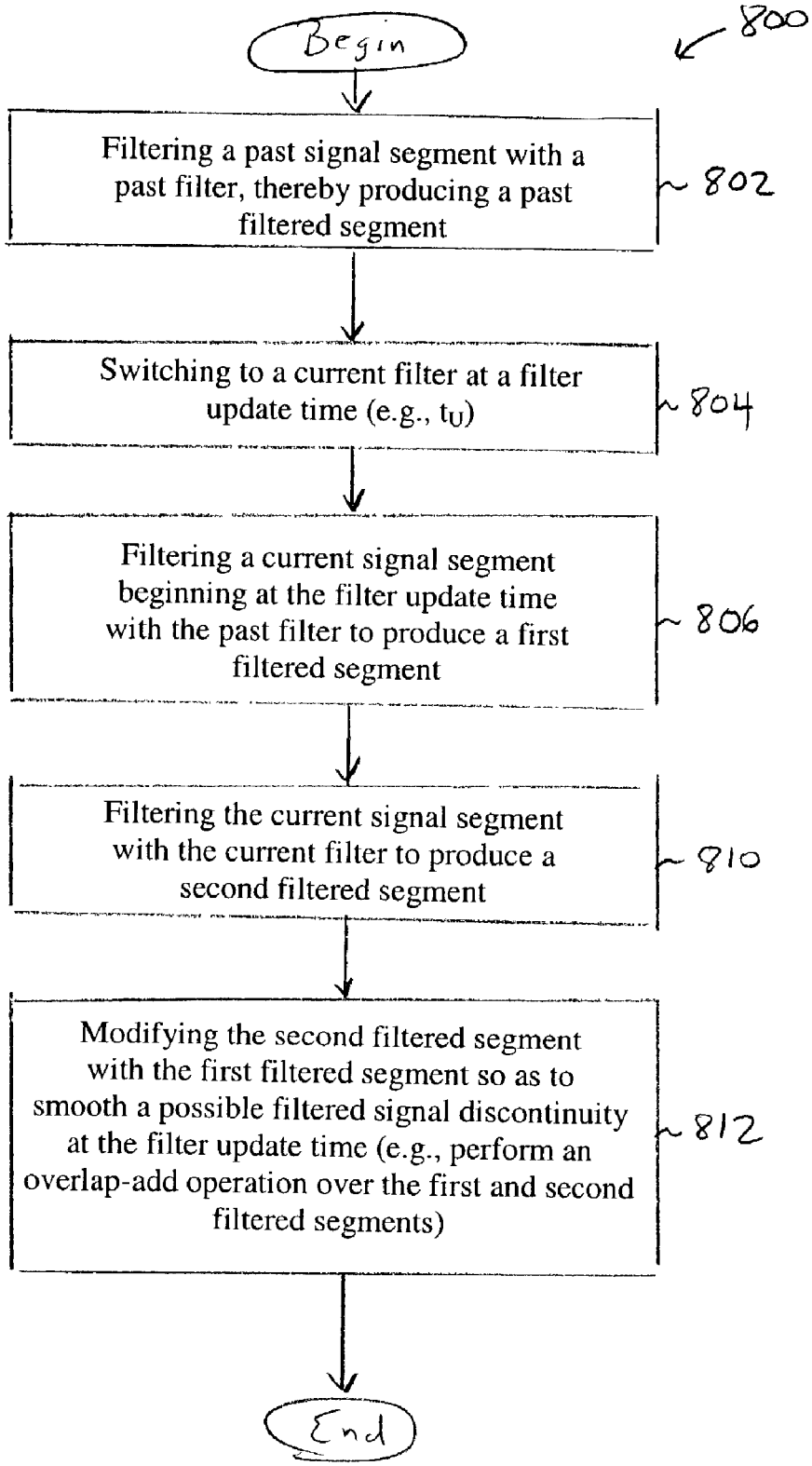
FIG. 8 is a flow chart of an example generalized method of adaptively filtering a generalized signal to smooth filtered signal discontinuities that may arise from a filter update.

FIG. 8 is a flow chart of an example method 800 of adaptively filtering a signal to avoid signal discontinuities that may arise from a filter update. Method 800 is described in connection with adaptive filter 600 and the waveforms of FIG. 7, for illustrative purposes.

A first step 802 includes filtering a past signal segment with a past filter, thereby producing a past filtered segment. For example, using filter F1, filter 602 filters a past signal segment 702 of signal 606, to produce a past filtered segment 704. This step corresponds to step 504 of method 500.

A next step 804 includes switching to a current filter at a filter update time. For example, adaptive filter 602 switches from filter F1 to filter F2 at filter update time $t_U$.

A next step 806 includes filtering a current signal segment beginning at the filter update time with the past filter, to produce a first filtered segment. For example, using filter F1, filter 602 filters a current signal segment 706 beginning at the filter update time $t_U$, to produce a first filtered segment 708. This step corresponds to step 506 of method 500. In an alternative arrangement, the order of steps 804 and 806 is reversed.

A next step 810 includes filtering the current signal segment with the current filter to produce a second filtered segment. The first and second filtered segments overlap each other in time beginning at time $t_U$. For example, using filter F2, filter 602 filters current signal segment 706 to produce a second filtered segment 710 that overlaps first filtered segment 708. This step corresponds to step 510 of method 500.

A next step 812 includes modifying the second filtered segment with the first filtered segment so as to smooth a possible filtered signal discontinuity at the filter update time. For example, filter 602 modifies second filtered segment 710 using first filtered segment 708 to produce a filtered, smoothed, output signal segment 714. This step corresponds to step 512 of method 500. Together, steps 806, 810 and 812 in method 800 smooth any discontinuities that may be caused by the switch in filters at step 804.

Adaptive filter 602 continues to filter signal 606 with filter F2 to produce filtered segment 716. Filtered output signal 608, produced by filter 602, includes contiguous successive filtered signal segments 704, 714 and 716. Modifying step 812 smoothes a discontinuity that may arise between filtered signal segments 704 and 710 due to the switch between filters F1 and F2 at time $t_U$, and thus causes a smooth signal transition between filtered output segments 704 and 714.

Various methods and apparatuses for processing signals have been described herein. For example, methods of deriving filter coefficients from a decoded speech signal, and methods of adaptively filtering a decoded speech signal (or a generalized signal) have been described. It is to be understood that such methods and apparatuses are intended to process at least portions or segments of the aforementioned decoded speech signal (or generalized signal). For example, the present invention operates on at least a portion of a decoded speech signal (e.g., a decoded speech frame or sub-frame) or a time-segment of the decoded speech signal. To this end, the term "decoded speech signal" (or "signal" generally) can be considered to be synonymous with "at least a portion of the decoded speech signal" (or "at least a portion of the signal").

8. Hardware and Software Implementations

Figure 9:
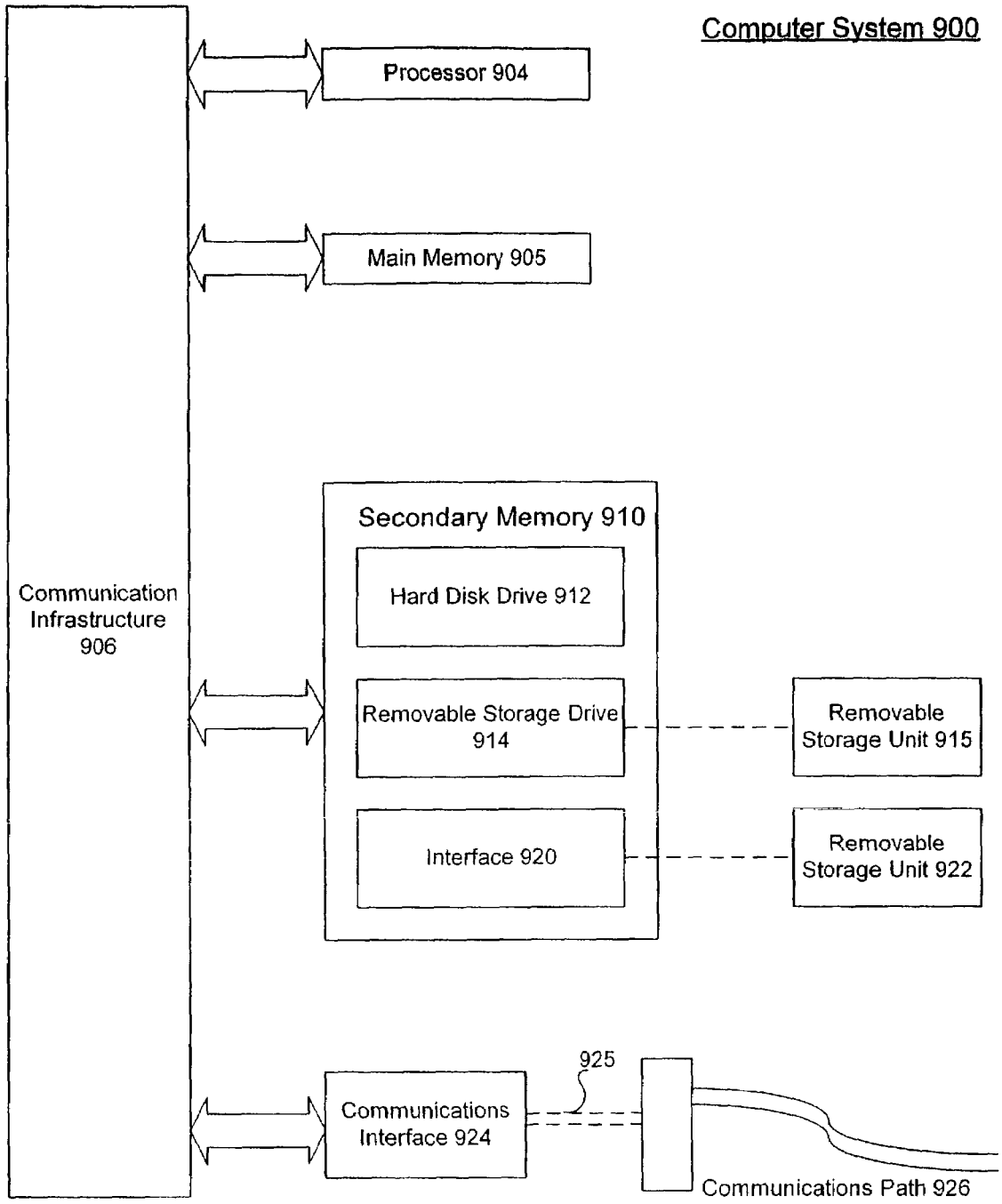
FIG. 9 is a block diagram of a computer system on which the present invention may operate.

The following description of a general purpose computer system is provided for completeness. The present invention can be implemented in hardware, or as a combination of software and hardware. Consequently, the invention may be implemented in the environment of a computer system or other processing system. An example of such a computer system 900 is shown in FIG. 9. In the present invention, all of the signal processing blocks depicted in FIGS. 1A, 2A–2B, 3–4, and 6, for example, can execute on one or more distinct computer systems 900, to implement the various methods of the present invention. The computer system 900 includes one or more processors, such as processor 904. Processor 904 can be a special purpose or a general purpose digital signal processor. The processor 904 is connected to a communication infrastructure 906 (for example, a bus or network). Various software implementations are described in terms of this exemplary computer system. After reading this description, it will become apparent to a person skilled in the relevant art how to implement the invention using other computer systems and/or computer architectures.

Computer system 900 also includes a main memory 905, preferably random access memory (RAM), and may also include a secondary memory 910. The secondary memory 910 may include, for example, a hard disk drive 912 and/or a removable storage drive 914, representing a floppy disk drive, a magnetic tape drive, an optical disk drive, etc. The removable storage drive 914 reads from and/or writes to a removable storage unit 915 in a well known manner. Removable storage unit 915, represents a floppy disk, magnetic tape, optical disk, etc. which is read by and written to by removable storage drive 914. As will be appreciated, the removable storage unit 915 includes a computer usable storage medium having stored therein computer software and/or data.

In alternative implementations, secondary memory 910 may include other similar means for allowing computer programs or other instructions to be loaded into computer system 900. Such means may include, for example, a removable storage unit 922 and an interface 920. Examples of such means may include a program cartridge and cartridge interface (such as that found in video game devices), a removable memory chip (such as an EPROM, or PROM) and associated socket, and other removable storage units 922 and interfaces 920 which allow software and data to be transferred from the removable storage unit 922 to computer system 900.

Computer system 900 may also include a communications interface 924. Communications interface 924 allows software and data to be transferred between computer system 900 and external devices. Examples of communications interface 924 may include a modem, a network interface (such as an Ethernet card), a communications port, a PCMCIA slot and card, etc. Software and data transferred via communications interface 924 are in the form of signals 925 which may be electronic, electromagnetic, optical or other signals capable of being received by communications interface 924. These signals 925 are provided to communications interface 924 via a communications path 926. Communications path 926 carries signals 925 and may be implemented using wire or cable, fiber optics, a phone line, a cellular phone link, an RF link and other communications channels. Examples of signals that may be transferred over interface 924 include: signals and/or parameters to be coded and/or decoded such as speech and/or audio signals and bit stream representations of such signals; any signals/parameters resulting from the encoding and decoding of speech and/or audio signals; signals not related to speech and/or audio signals that are to be filtered using the techniques described herein.

In this document, the terms "computer program medium" and "computer usable medium" are used to generally refer to media such as removable storage drive 914, a hard disk installed in hard disk drive 912, and signals 925. These computer program products are means for providing software to computer system 900.

Computer programs (also called computer control logic) are stored in main memory 905 and/or secondary memory 910. Also, decoded speech frames, filtered speech frames, filter parameters such as filter coefficients and gains, and so on, may all be stored in the above-mentioned memories. Computer programs may also be received via communications interface 924. Such computer programs, when executed, enable the computer system 900 to implement the present invention as discussed herein. In particular, the computer programs, when executed, enable the processor 904 to implement the processes of the present invention, such as the methods illustrated in FIGS. 2A–2B, 3–5 and 8, for example. Accordingly, such computer programs represent controllers of the computer system 900. By way of example, in the embodiments of the invention, the processes/methods performed by signal processing blocks of quantizers and/or inverse quantizers can be performed by computer control logic. Where the invention is implemented using software, the software may be stored in a computer program product and loaded into computer system 900 using removable storage drive 914, hard drive 912 or communications interface 924.

In another embodiment, features of the invention are implemented primarily in hardware using, for example, hardware components such as Application Specific Integrated Circuits (ASICs) and gate arrays. Implementation of a hardware state machine so as to perform the functions described herein will also be apparent to persons skilled in the relevant art(s).

9. Conclusion

While various embodiments of the present invention have been described above, it should be understood that they have been presented by way of example, and not limitation. It will be apparent to persons skilled in the relevant art that various changes in form and detail can be made therein without departing from the spirit and scope of the invention.

The present invention has been described above with the aid of functional building blocks and method steps illustrating the performance of specified functions and relationships thereof. The boundaries of these functional building blocks and method steps have been arbitrarily defined herein for the convenience of the description. Alternate boundaries can be defined so long as the specified functions and relationships thereof are appropriately performed. Also, the order of method steps may be rearranged. Any such alternate boundaries are thus within the scope and spirit of the claimed invention. One skilled in the art will recognize that these functional building blocks can be implemented by discrete components, application specific integrated circuits, processors executing appropriate software and the like or any combination thereof. Thus, the breadth and scope of the present invention should not be limited by any of the above-described exemplary embodiments, but should be defined only in accordance with the following claims and their equivalents.

What is claimed is:

1. A method of filtering an audio signal, the audio signal including successive signal frames, comprising:

(a) filtering a beginning portion of a current signal frame using a past set of filter coefficients, thereby producing a first filtered frame portion;

(b) filtering the beginning portion of the current signal frame using a current set of filter coefficients, thereby producing a second filtered frame portion; and (c) modifying the second filtered frame portion with the first filtered frame portion so as to smooth a possible filtered signal discontinuity between the second filtered frame portion and a past filtered frame produced using the past filter coefficients.

2. The method of claim 1, wherein step (c) comprises performing an overlap-add operation over the second filtered frame portion and the first filtered frame portion.

3. The method of claim 1, wherein step (c) comprises:

(d)(i) weighting the first filtered frame portion with a first weighting function to produce a first weighted filtered frame portion;

(d)(ii) weighting the second filtered frame portion with a second weighting function to produce a second weighted filtered frame portion;

(d)(iii) combining the first and second weighted filtered frame portions.

4. The method of claim 3, wherein step (d)(iii) comprises:

adding together the first and second weighted filtered frame portions.

5. The method of claim 3, wherein each of the first and second weighting functions is one of a triangular function and a raised cosine function.

6. The method of claim 3, further comprising:

deriving the current filter coefficients based on at least a part of the current signal frame; and deriving the past filter coefficients based on at least a part of a past signal frame.

7. The method of claim 1, further comprising:

prior to step (a), filtering the past signal frame using the past set of filter coefficients, thereby producing the past filtered frame, wherein step (c) comprises modifying the second filtered frame portion with the first filtered frame portion so as to smooth a possible filtered signal discontinuity between the second filtered frame portion and the past filtered frame.

8. The method of claim 1, wherein the signal is a decoded speech (DS) signal including successive DS frames, and the beginning portion of the current signal frame is a beginning portion of a current DS frame.

9. The method of claim 8, wherein:

step (a) comprises at least one of short-term and long-term filtering the beginning portion of the current DS frame using at least one of past short-term filter coefficients and past long-term filter coefficients, respectively; and step (b) comprises at least one of short-term and long-term filtering the beginning portion of the current frame using at least one of current short-term and current long-term filter coefficients, respectively.

10. The method of claim 9, wherein:

step (a) further comprises gain scaling, with a past gain, a first intermediate filtered DS frame portion resulting from said at least of short-term and long-term filtering; and step (b) further comprises gain scaling, with a current gain, a second intermediate filtered DS frame portion resulting from said at least one of short-term and long-term filtering.

11. The method of claim 9, further comprising:

deriving the current short-term filter coefficients based on at least a part of the current DS frame; and deriving the past short-term filter coefficients based on at least a part of the past DS frame.

12. A computer program product (CPP) comprising a computer usable medium having computer readable program code (CRPC) means embodied in the medium for causing an application program to execute on a computer processor to filter an audio signal, the audio signal including successive signal frames, comprising:

first CRPC means for causing the processor to filter a beginning portion of a current signal frame using a past set of filter coefficients, thereby producing a first filtered frame portion;

second CRPC means for causing the processor to filter the beginning portion of the current signal frame using a current set of filter coefficients, thereby producing a second filtered frame portion; and third CRPC means for causing the processor to modify the second filtered frame portion with the first filtered frame portion so as to smooth a possible filtered signal discontinuity between the second filtered frame portion and a past filtered frame produced using the past filter coefficients.

13. The CPP of claim 12, wherein the third CRPC means includes CRPC means for causing the processor to performing an overlap-add operation over the second filtered frame portion and the first filtered frame portion.

14. The CPP of claim 12, wherein the third CRPC means includes:

first weighting CRPC means for causing the processor to weight the first filtered frame portion with a first weighting function to produce a fist weighted filtered frame portion;

second weighting CRPC means for causing the processor to weight the second filtered frame portion with a second weighting function to produce a second weighted filtered frame portion; and combining CRPC means for causing the processor to combine the first and second weighted filtered frame portions.

15. The CPP of claim 14, wherein the combining CRPC means includes CRPC means for causing the processor to add together the first and second weighted filtered frame portions.

16. The CPP of claim 14, wherein each of the first and second weighting functions is one of a triangular function and a raised cosine function.

17. The CPP of claim 12, wherein the signal is a decoded speech (DS) signal including successive DS frames, and the beginning portion of the current signal frame is a beginning portion of a current DS frame.

18. The CPP of claim 17, wherein:

the first CRPC means includes at least one of

CRPC means for causing the processor to short-term filter the beginning portion of the current DS frame using past short-term filter coefficients, and CRPC means for causing the processor to long-term filter the beginning portion of the current DS frame using past long-term filter coefficients; and the second CRPC means includes at least one of CRPC means for causing the processor to short-term filter the beginning portion of the current DS frame using current short-term filter coefficients, and CRPC means for causing the processor to long-term filter the beginning portion of the current DS frame using current long-term filter coefficients.

19. The CPP of claim 18, wherein:

the first CRPC means further includes CRPC means for causing the processor to gain scale, with a past gain, a first intermediate filtered DS frame portion resulting from said at least of short-term and long-term filtering; and the second CRPC means further includes CRPC means for causing the processor to gain scale, with a current gain, a second intermediate filtered DS frame portion resulting from said at least one of short-term and long-term filtering.

20. An apparatus for filtering an audio signal, the audio signal including successive signal frames, comprising:

first means for filtering a beginning portion of a current signal frame using a past set of filter coefficients, thereby producing a first filtered frame portion;

second means for filtering the beginning portion of the current signal frame using a current set of filter coefficients, thereby producing a second filtered frame portion; and third means for modifying the second filtered frame portion with the first filtered frame portion so as to smooth a possible filtered signal discontinuity between the second filtered frame portion and a past filtered frame produced using the past filter coefficients.

21. The apparatus of claim 20, wherein the third means comprises means for performing an overlap-add operation over the second filtered frame portion and the first filtered frame portion.

22. The apparatus of claim 20, wherein the third means comprises:

means for weighting the first filtered frame portion with a first weighting function to produce a fist weighted filtered frame portion;

means for weighting the second filtered frame portion with a second weighting function to produce a second weighted filtered frame portion; and means for combining the overlapped first and second weighted filtered frame portions.

23. The apparatus of claim 22, wherein the combining means comprises means for adding together the first and second weighted filtered frame portions.

24. The apparatus of claim 22, wherein each of the first and second weighting functions is one of a triangular function and a raised cosine function.

25. The apparatus of claim 20, wherein the signal is a decoded speech (DS) signal including successive DS frames, and the beginning portion of the current signal frame is a beginning portion of a current DS frame.

* * * * *